US007121938B2

(12) United States Patent
Suzuki

(10) Patent No.: US 7,121,938 B2
(45) Date of Patent: Oct. 17, 2006

(54) POLISHING PAD AND METHOD OF FABRICATING SEMICONDUCTOR SUBSTRATE USING THE PAD

(75) Inventor: Tatsutoshi Suzuki, Yokkaichi (JP)

(73) Assignee: Toho Engineering Kabushiki Kaisha, Mie (JP)

( * ) Notice: Subject to any disclaimer, the term of this patent is extended or adjusted under 35 U.S.C. 154(b) by 0 days.

(21) Appl. No.: 10/482,740

(22) PCT Filed: Apr. 1, 2003

(86) PCT No.: PCT/JP03/04189

§ 371 (c)(1),
(2), (4) Date: Jan. 5, 2004

(87) PCT Pub. No.: WO03/083918

PCT Pub. Date: Oct. 9, 2003

(65) Prior Publication Data

US 2004/0198056 A1 Oct. 7, 2004

(30) Foreign Application Priority Data

Apr. 3, 2002 (JP) ..... 2002-101945
Dec. 27, 2002 (JP) ..... 2002-378965

(51) Int. Cl.
*B24B 1/00* (2006.01)
*B24D 11/00* (2006.01)

(52) U.S. Cl. ..... 451/527; 451/41; 451/286; 451/287; 451/288; 451/526; 451/529; 451/539

(58) Field of Classification Search ..... 451/41, 451/286, 287, 288, 526, 527, 529, 539
See application file for complete search history.

(56) References Cited

U.S. PATENT DOCUMENTS

| | | | | |
|---|---|---|---|---|
| 5,536,202 | A * | 7/1996 | Appel et al. | 451/285 |
| 5,921,855 | A | 7/1999 | Osterheld et al. | |
| 5,984,769 | A | 11/1999 | Bennett et al. | |
| 6,238,271 | B1 | 5/2001 | Cesna | |
| 6,364,749 | B1 | 4/2002 | Walker | |

FOREIGN PATENT DOCUMENTS

| | | |
|---|---|---|
| JP | 11-277407 A | 10/1999 |
| JP | 2000-349053 | 12/2000 |
| JP | 2000-354952 | 12/2000 |
| JP | 2001-18165 | 1/2001 |
| JP | A 2001-18164 | 1/2001 |
| JP | 2002-011630 A | 1/2002 |

* cited by examiner

*Primary Examiner*—Joseph J. Hail, III
*Assistant Examiner*—Shantese McDonald
(74) *Attorney, Agent, or Firm*—Oliff & Berridge PLC

(57) ABSTRACT

It is provided a polishing pad of novel construction capable of controlling actively and efficiently a slurry flow during polishing a surface of a semiconductor substrate, such as a wafer, thus making it possible to precisely and stably performing a desired polishing process. Onto a surface of a pad substrate 12 of synthetic resin material, formed is a groove 16 extending approximately circumferentially. An inner circumferential wall surface 20 and an outer circumferential wall surface 22 are made parallel to each other and slant with respect to a center axis 18 of the pad substrate 12.

9 Claims, 22 Drawing Sheets

CONTACT PRESSURE DISTRIBUTION (SLOPE ANGLE $\alpha$=0°)

CONTACT PRESSURE DISTRIBUTION (SLANT ANGLE $\alpha = -5°$ )

CONTACT PRESSURE DISTRIBUTION (SLANT ANGLE $\alpha = -10°$ )

CONTACT PRESSURE DISTRIBUTION (SLANT ANGLE $\alpha = +5°$ )

CONTACT PRESSURE DISTRIBUTION (SLANT ANGLE $\alpha$=+10°)

POLISHING PAD AND METHOD OF FABRICATING SEMICONDUCTOR SUBSTRATE USING THE PAD

TECHNICAL FIELD

The present invention relates to a polishing pad for use in a semiconductor fabrication process, for polishing a surface of a semiconductor substrate, e.g., a semiconductor wafer or a semiconductor device. The present invention also relates to techniques associated with the polishing pad, e.g., a method of fabricating a semiconductor substrate using the polishing pad.

BACKGROUND ART

In the process of fabricating semiconductor devices such as LSI devices, conventionally, a lamination of various kinds of thin layers including metallic layers and insulative layers are formed on a silicon wafer, for example, through various processing steps. As one major for polishing or planarizing an outer or upper most surface of the wafer to obtain a substrate surface having a high degree of planarity, chemical mechanical polishing (hereinafter referred to as "CMP") is known, wherein a thin disk-shaped polishing pad of synthetic resin material or expanded material thereof may be employed, and the polishing pad and the wafer (semiconductor substrate) are made to undergo relative rotation while supplying between the wafer and the pad a slurry consisting of fine abrasive particles and a suitable kind of liquid, for effect polishing.

In order to meet a great demand for a highly integrated, high-precision semiconductor device, it is required to produce multiple layers of intricate patterns of extremely fine lines. To meet this end, the CMP process is required to ensure (a) "polishing precision", i.e. the ability to polish an entire wafer surface with highly precise planarization, and (b) "polishing efficiency", i.e. the ability to polish a wafer with high process efficiency. Higher circuit densities seen in semiconductor devices in recent years have raised the bar still further as regards these two capabilities.

To meet such requirements, there has been proposed polishing pads for use in CMP processes, in which the surface of the polishing pad (i.e. the surface which polishes the wafer) is provided with a multitude of tiny holes, or with linearly extending grooves or radially extending grooves. Pads of this kind are disclosed in Patent Document Nos. 1, 2, 3, for example.

However, notwithstanding the use of these polishing pads of conventional design, it is still exceedingly difficult to achieve both "polishing precision" and "polishing efficiency" at levels adequate to meet requirements. In the field of super LSI in particular, metallic interconnect or metallization width of lines formed on the wafer (line patterns with metal line) is extremely narrow, i.e., 0.18 μm or smaller, and accordingly the surface must be polished to a very low degree of surface roughness (Rz), i.e. 0.25 μm or smaller. Also, the use of recently soft metal such as cooper and gold for metallization has entered the stage of research directed to practical application. In view of the above, still further improvements are required to polishing pads in order to achieve satisfactory levels of polishing precision and polishing efficiency.

As one measures for improving polishing precision in CMP processes, Patent Document No. 4 teaches a polishing pad having grooves that, viewed in cross section, expand in dimension toward the pad surface. According to Patent Document No. 4, the slant side wall of the groove guides the slurry and polishing residues, thus improving polishing precision.

However, research conducted by the inventors has revealed that when grooves like those taught in Patent Document No. 4 are formed on a polishing pad surface, polishing performance, which includes both polishing efficiency and polishing precision is inconsistent. Therefore, practical use would be extremely difficult. It is thought that the major reason for this drawback is the variation in the width dimension of the groove in its depthwise direction.

In addition to wear produced in wafer polishing, a polishing pad is typically subjected to a conditioning process (dressing) by means of abrading the pad surface at predetermined process time intervals. However, the grooves taught in Patent Document No. 4 unavoidably experience appreciable change in groove width due to polishing-induced wear and surface conditioning, and this is accompanied by significant variation in parameters such as the distribution of stress. Thus, consistent polishing characteristics may be not achieved.

(Patent Document No. 1)
U.S. Pat. No. 5,921,855

(Patent Document No. 2)
U.S. Pat. No. 5,984,769

(Patent Document No. 3)
U.S. Pat. No. 6,364,749

(Patent Document No. 4)
U.S. Pat. No. 6,238,271

DISCLOSURE OF INVENTION

The present invention has been developed in order to solve the above-described problems, and it is therefore one object of this invention to provide a polishing pad of novel construction whereby the surface of a semiconductor substrate or similar material can be processed with consistently high levels of "polishing precision" and "polishing efficiency" using a CMP or similar process.

It is another object of the present invention to provide a novel semiconductor substrate fabrication method employing a polishing pad, whereby in a semiconductor fabrication process employing a suitable method such as CMP for polishing the substrate surface, the object semiconductor substrate may be fabricated with consistently high levels of "precision" and "efficiency".

It is yet another object of the present invention to provide a cutting tool for machining a groove in a polishing pad, which is capable of producing a polishing pad of novel construction pertaining to the invention, and a useful production method for the polishing pad.

There will be described modes of the invention that have been developed in an effort to achieve at least one of these objects of the invention. Every elements employed in the following modes may be adoptable in any other possible combinations. It is to be understood that principle or technical features of the invention are not limited to the following modes of the invention and combinations of the technical features, but may otherwise be recognized based on the concepts of the present invention disclosed in the entire specification and drawings or that may be recognized by those skilled in the art in the light of the present disclosure.

(First Mode of the Invention Relating to Polishing Pad)

A first mode of the invention relating to a polishing pad provides a polishing pad for use in polishing a semiconductor substrate, wherein a pad substrate of synthetic resin has at least one groove formed in a surface thereof, characterized in that the groove is at least partially constituted of a slant groove having two side walls that are slant substantially parallel to each other in a depthwise direction with respect to an center axis of the pad substrate.

According to the present invention, the use of the slant groove having slant side walls permits that centrifugal force created by rotation of the polishing pad actively acts as a component force corresponding to the slant angle of the slant groove on slurry and other material presented in the groove. This makes it possible to control the flow state of slurry and other material present between the polishing pad and the wafer or other semiconductor substrate. In polishing processes such as CMP that employ specific slurries, a chemical polishing action plays a significant role in addition to simple mechanical polishing. Namely, movement of the slurry abrasive grains between the wafer and polishing pad has a significant effect on the precision and consistency of polishing. According to the present invention, it is therefore possible to appropriately establish and adjust polishing performance, depending upon the polishing pad material or degree of precision required, for example, by suitably controlling movement of slurry abrasive grains between the wafer and pad during polishing, through suitable adjustment of the direction and angle of incline of the slant groove. Alternatively, through proper adjustment of the direction and angle of slant of the slant groove, it is possible to minimize the adverse effects of polishing residues and other contaminants produced during polishing, as well as to induce polishing residues or other material entering the slant groove during polishing to be actively detained within the slant groove, or conversely to be actively swept out from the slant groove, through centrifugal action, thereby further improving consistency in polishing precision.

According to the polishing pad of this mode, it is additionally possible to design the groove including the slant groove with essentially constant width dimension across its depthwise direction. Thus, if the depth of the groove should change due to wear of the polishing pad in the course of polishing, or to dressing of the polishing pad surface, the groove width will maintained substantially constant so that the desired polishing performance, including polishing efficiency and polishing precision, are maintained.

In the present mode, the material for the pad substrate is not particularly limited, it being possible to employ appropriately any number of materials selected with reference to the article being polished, required polishing parameters, and the like. Favorable are rigid materials such as expanded or unexpanded polyurethane resin for use. The polishing pad constructed according to the present invention may be used for polishing by securing to a rotating support plate by conventional methods, naturally, the method of securing to the support plate is not particularly limited, it being possible to secure the pad juxtaposed directly onto a support plate of rigid material such as metal, or to secure it on the support face of the support plate via a suitable resilient pad.

(Second Mode of the Invention Relating to Polishing Pad)

A second mode of the invention relating to a polishing pad provides a polishing pad according to the first mode, wherein the slant groove is constituted by a circumferential groove extending substantially in a circumferential direction about the center axis of the pad substrate. In this mode, the circumferential groove arrangement for the slant groove further enhances the effect on slurry and polishing residues present in the slant groove by the centrifugal force generated through rotation of the polishing pad about its center axis of rotation.

(Third Mode of the Invention Relating to Polishing Pad)

A third mode of the invention relating to a polishing pad provides a polishing pad according to the second mode, wherein the two side walls of said circumferential groove slant outwardly in the depthwise direction toward an opening, in a diametrical direction of the pad substrate. The polishing pad according to this mode is able to actively cause flow of slurry, polishing residues and the like present in the slant groove in a direction out from the slant groove, thereby promoting circulation of slurry supplied to between the polishing pad and wafer from the central portion of the polishing pad, and more effectively preventing clogging of the slant groove due to intrusion of polishing residues, for example.

(Fourth Mode of the Invention Relating to Polishing Pad)

A fourth mode of the invention relating to a polishing pad provides a polishing pad according to the second or third mode, wherein the circumferential groove is formed in multiple segments spaced apart at intervals on a diametric line of said pad substrate, and an slant angle of the two side walls of the circumferential groove varies depending on a diametric distance away from the center axis of the pad substrate. The polishing pad according to this mode enables more varied control of the flow of slurry etc. across the diameter of the polishing pad. In view of the fact that consideration the fact that centrifugal force acting on slurry in the slant groove changes according to the diametric distance away from the center axis of the pad substrate, it is possible, by varying gradually or in stepwise fashion the slant angle of the slant groove side walls, to maintain throughout the polishing pad as constant a level of centrifugal force as possible on the slurry in the slant groove over a wide area of the polishing pad, for example.

(Fifth Mode of the Invention Relating to Polishing Pad)

A fifth mode of the invention relating to a polishing pad provides a polishing pad according to any one of first to fourth modes, wherein the slant groove comprises a plurality of linear grooves each extending linearly. In the polishing pad according to this mode as well, slurry or polishing residues present within the slant grooves can be actively caused to flow or be retained through the action of centrifugal force produced by rotation of the polishing pad about its center axis. Also, the flow of slurry etc. can be controlled through the position and number of slant grooves, in addition to the slant angle thereof. By combining this mode with any of the first to fourth modes, combinations of both circumferential grooves and linear grooves can be produced on the surface of a single polishing pad.

(Sixth Mode of the Invention Relating to Polishing Pad)

A sixth mode of the invention relating to a polishing pad provides a polishing pad according to fifth mode, wherein the linear grooves are formed as a plurality of groove groupings each consisting of mutually parallel grooves, with the groove groupings arranged intersecting one another in a substantially reticulated arrangement. In the polishing pad according to this mode, the use of the plurality of groove groupings permits substantially uniform action of the linear grooves over the entire polishing face of the polishing pad, thereby affording greater consistency in polishing precision and polishing efficiency.

(Seventh Mode of the Invention Relating to Polishing Pad)

A seventh mode of the invention relating to a polishing pad provides a polishing pad according to sixth mode, wherein the plurality of the linear grooves making up each of the groove groupings have placement and incline direction that are substantially symmetrical to one another to either side of a single plane that contains the center axis of the pad substrate and extends parallel to the plurality of linear grooves. In the polishing pad according to this mode, linear grooves can be made to produce more uniform action over the polishing face of the polishing pad. Preferably, the linear grooves extending at locations diametrically intersection the center axis of the polishing pad are arranged to be grooves having side walls that rise parallel to the center axis of the pad substrate.

(Eighth Mode of the Invention Relating to Polishing Pad)

An eighth mode of the invention relating to a polishing pad provides a polishing pad according to any one of first to seventh modes, wherein said slant groove measures 0.005–2.0 mm in width dimension. In this mode, the slant groove width dimension is made sufficiently small, making it possible to achieve a high degree of polishing precision. In this regard, since the side walls of the slant groove incline, problems tending to occur as a result of the small-width slant groove, such as retaining of slurry within the groove or clogging of the groove by polishing residues, can be effectively avoided, thereby effectively and consistently providing the desired degree of polishing precision.

Groove depth dimension and diametric pitch are not particularly limited, and may be selected appropriately with reference to the material of the polishing pad, the material being polished, properties of the slurry being used, the required degree of polishing precision, and other parameters. The groove depth dimension is typically 0.1–2.0 mm, and particularly in the case of substantially circular grooves extending in the circumferential direction, the slant grooves will be formed substantially parallel at intervals of 0.1–3.0 mm apart. In the case of linear grooves, even if grooves are spaced widely away from one another, localized action on an article being polished due to rotation of the polishing pad is less intense than with circular grooves extending in the circumferential direction. Therefore, it is a simple matter to achieve good polishing characteristics even with larger groove spacing, which preferably may be appropriately set within a wide range of 0.1 to 60.0 mm, for example.

(Ninth Mode of the Invention Relating to Polishing Pad)

A ninth mode of the first aspect of the invention provides a polishing pad according to any one of first to eighth modes, wherein the slant groove is provided with a groove dimensional error of 5% or smaller. According to this mode, the slant groove is formed with a dimensional accuracy enhanced to a predetermined value, permitting the polishing pad to polish a semiconductor substrate with minimized variation in polishing pressure exerted through the polishing pad on the semiconductor substrate. For instance, the polishing pad according to this mode is capable of minimizing variation in polishing pressure to a theoretical target value, e.g., in an order of 2% or smaller. By the term "groove dimensional error", meant is not only a groove width, but also a groove pitch and a groove depth.

(First Mode of the Invention Relating to Method of Fabricating Semiconductor Substrate)

A first mode of the invention relating to a method of fabricating a semiconductor substrate provides a method of fabricating a semiconductor substrate characterized by the step of polishing a semiconductor substrate using a polishing pad with a slant groove constructed according to the present invention relating to a polishing pad described hereinabove. According to the method herein, movement of the abrasive particles of a slurry between the semiconductor substrate and polishing pad can be controlled by the action of slant grooves like those described previously formed on the polishing pad surface, on the basis of the slant groove slant angle, polishing pad rotation speed, and the like. This enables the target semiconductor substrate to be fabricated with excellent polishing precision and polishing efficiency. According to the method herein, semiconductor substrates having line patterns with metal line widths of not greater than 0.18 μm can be polished effectively.

(Second Mode of the Invention Relating to Method of Fabricating Semiconductor Substrate)

A second mode of the invention relating to a method of fabricating a semiconductor substrate provides a semiconductor fabricating method according to first mode, characterized by the step of polishing the semiconductor substrate under a polishing pressure whose variation is held in an order of 2% or smaller. According to this method, since the polishing pressure variation is in the order of 2% or smaller, semiconductors of ongoing designs can be fabricated with excellent yield. In particular, the present method can be advantageously effected by using a polishing pad of construction according to the ninth mode of the invention relating to the polishing pad described hereinabove.

(First Mode of the Invention Relating to Polishing Pad Producing Method)

A first mode of the invention relating to a polishing pad producing method provides a method of producing a polishing pad characterized by the step of cutting into a surface of a pad substrate of synthetic resin a slant groove having two substantially parallel side walls slant in a depthwise direction with respect to a center axis of the pad substrate, with a cutting tool having a cutting part to be placed in contact on an incline against the surface of the pad substrate at side faces thereof. According to the method of this mode, it is easier to produce the slant groove on the polishing pad surface than would be the case with, for example, groove machining using a rotary tool, thereby affording efficient manufacture of a polishing pad with a slant groove, and having a construction according to the invention described hereinabove.

(Second Mode of the Invention Relating to Polishing Pad Producing Method)

A second mode of the invention relating to a polishing pad producing method provides a method of producing a polishing pad according to the first mode herein, characterized by the step of turning the slant groove so as to extend substantially circumferentially with the cutting tool placed against the surface of the pad substrate, while rotating the pad substrate of synthetic resin about a center axis thereof. According to the method of this mode, it is a simple matter to produce a plurality of slant grooves of circular, elliptical or petal shape as disclosed in FIG. 13 of U.S. Pat. No. 5,984,769, extending concentrically along the circumference of the polishing pad, or a slant groove extending in spiral configuration.

(Third Mode of the Invention Relating to Polishing Pad Producing Method)

A third mode of the invention relating to a polishing pad producing method provides a method of producing a polishing pad according to the first or second mode herein, characterized by the step of cutting the slant groove by gradually advancing the cutting part of the cutting tool in a direction of incline against the surface of the pad substrate, while subjecting a groove producing location on the surface of the pad substrate to a plurality of repeated cutting cycles. According to the method of this mode, the slant groove having smooth inner surfaces can be produced consistently, enabling the desired slant groove to be formed with sufficiently small groove width. Where the slant groove being produced is a linear groove, spiral groove, or other such finite shape, when performing a plurality of cutting cycles in one direction or in a reciprocating manner, it is preferable to increase blade projection stepwise in small increments. More specifically described, the blade projection may be increased in a regular increment for each reciprocating cycle, or alternatively may be increased irregularly in appropriate amounts, for example. On the other hand, where the slant groove being produced is an endless shape such as circumferential groove, when performing a plurality of cutting cycles continuously on a single circuit, the blade projection may be increased either stepwise in small increments for each full circuit, or continuously regardless of the circuit.

(Fourth Mode of the Invention Relating to Polishing Pad Producing Method)

A fourth mode of the invention relating to a polishing pad producing method provides a method of producing a polishing pad according to any one of first to third modes herein, characterized by the steps of: blowing ionized air from a back of the cutting part during cutting by the cutting tool the slant groove into the pad substrate in order to prevent chips from being charged; and suctioning and collecting the chips forwarded to a front of the cutting part therefrom. According to the pad producing method of this mode, ions, which are adapted to neutralize static electricity charged in the pad substrate and cut-parts (chips) due to friction during cutting, are discharged together with compression air toward the pad substrate from the vicinity of the cutting part of the cutting tool, thereby preventing the chips from being adhered to the inside of grooves cut. In addition, the chips neutralized by the ions and left on the surface of the pad substrate can be promptly suctioned and removed from the surface of the pad substrate. The method of this mode can eliminate drawbacks such as excessively large cutting at walls of the slant groove, which may be caused by chips adhered to walls or other parts of the slant groove. This method therefore makes it possible to form onto the pad substrate the slant groove or the like with high dimensional accuracy. In this regards, blowing of ionized air and suctioning and collecting the chips can be effectively performed by means of known air blowers for use in neutralizing static electrical charge utilizing Corona Discharge, and known dust collectors or the like, respectively. Preferably, the ionized air may be blown with a slant angle approximately equal to that of the slant groove. Hence ions can be effectively applied even to the inner circumferential surface and the floor of the slant groove, which provide undercut formations with respect to the surface of the pad substrate, thus making it possible to suction and collect the chips adhered to these inner circumferential surfaces and floor of the slant groove.

(Fifth Mode of the Invention Relating to Polishing Pad Producing Method)

A fifth mode of the invention relating to a polishing pad producing method provides a method of producing a polishing pad according to any one of first to fourth modes herein, characterized by the steps of: cutting simultaneously a plurality of the slant grooves by means of a multi edged tool in which a plurality of the cutting parts are arranged in series with respect to a cutting direction; and blowing the ionized air from a back toward a front of the multi edged tool through gaps between the plurality of the cutting parts. According to the method of this mode, the chips can be forwarded to the front of the multi edged tool by effectively utilizing the gaps between the plurality of the cutting parts, making it possible to advantageously prevent the chips from being adhered to the walls of the grooves even in the case where the multi edged tool is employed.

(First mode of the Invention Relating to Cutting Tool)

A first mode of the invention relating to a cutting tool provides a cutting tool comprising a cutting part for cutting a groove in a surface of a pad substrate of synthetic resin, characterized by that the cutting part includes a cutting edge and two side faces slant in a same lateral direction with respect to the cutting edge of the cutting part. The cutting tool having construction according to the present mode is advantageous in implementing the method of producing the polishing pad according to the invention described above, and can be used in producing by means of a cutting process the slant groove whose two side walls are slant with respect to the center axis of the pad substrate and whose floor is orthogonal to the center axis of the pad substrate, as viewed in cross section.

(Second Mode of the Invention Relating to Cutting Tool)

A second mode of the invention relating to a cutting tool provides a cutting tool according to the first mode, characterized by that the cutting tool comprises a multi-edged tool having a plurality of said cutting parts arranged in series with respect to a cutting direction in order to enable simultaneous cutting of a multiplicity of said grooves. This mode affords improved productivity through the ability to efficiently cut a plurality of slant grooves.

(Third Mode of the Invention Relating to Cutting Tool)

A third mode of the invention relating to a cutting tool provides a cutting tool characterized by that the cutting tool includes a groove cutting tool for turning a groove extending substantially circumferentially into said surface of said pad substrate, while rotating said pad substrate about a center axis thereof, said groove cutting tool having at least one cutting part having a tooth width of 0.005–3.0 mm, a wedge angle of 15–35 degrees, and a front clearance angle of 65–45 degreee.

The use of the cutting tool of construction according to the present mode makes it possible to produce more advantageously a groove (including a slant groove) into the polishing pad, and to improve the precision and shape consistency of the inside surfaces of the groove. Particularly, since the front clearance angle measures 65–45 degrees, when cutting a groove with a small radius of curvature sufficiently close to the inner diameter of the pad substrate, catching of the sides of the cutting part can be reduced or avoided, so that the outer diameter side of the groove can be produced with high dimensional precision or accuracy, making it possible to produce substantially uniform grooves extending substantially in the circumferential direction over a wide surface area on the polishing pad with high precision.

Preferably, the groove-machining cutting tool is arranged to have a tooth width of 0.005–2.0 mm. Such a narrow tool is employed. In the groove machining tool according to the present invention, it is advantageous to employ a multi-edged tool having a plurality of cutting parts arrayed in the tooth width direction, whereby a plurality of concentric grooves can be turned efficiently. In the case of a multi-edged tool having a plurality of cutting parts arranged in the tooth width direction, the cutting parts may be arranged at the same pitch as the desired groove pitch (spacing), or alternatively may be arranged with a wide gap in between by making the cutting part pitch some suitable multiple (two times or greater) of the desired groove pitch. The latter multi edged tool may be used for cutting a plurality of grooves all at once, while being offset in small increments depending on the groove pitch.

BEST MODE FOR CARRYING OUR THE INVENTION

There will be described in detail preferred embodiments of the invention with reference to accompanying drawings in order to further clarify the present invention.

Figure 1:
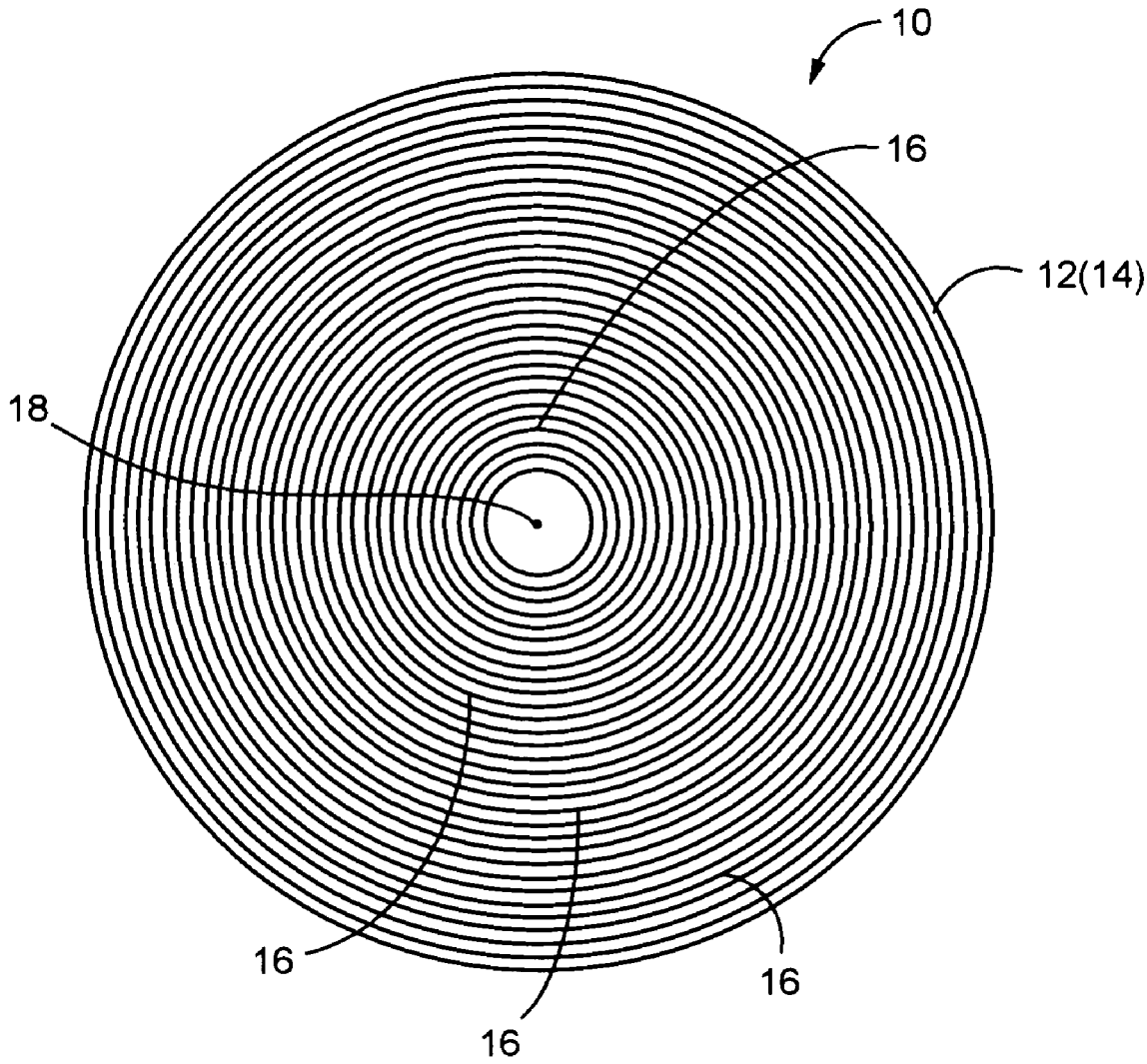
FIG. 1 is a plane view of a polishing pad according to one embodiment of the invention.

Referring first to FIG. 1, shown is a polishing pad 10 of construction according to a first embodiment of the present invention. The polishing pad 10 is constituted by a thin disk pad substrate 12 having a constant thickness dimension T overall. The pad substrate 12 is advantageously formed of rigid expanded urethane, for example. The pad thickness dimension is not particularly limited, and may be selected appropriately depending not only on the material of the pad substrate 12 but also the material of the wafer being polished, the required degree of polishing precision, and the like.

One surface 14 of the pad substrate 12, serving as a processed surface, has a groove 16 formed thereon so as to extend in a circumferential direction about an center axis 18 of the pad substrate 12, and to be open in the surface 14.

Figure 2:
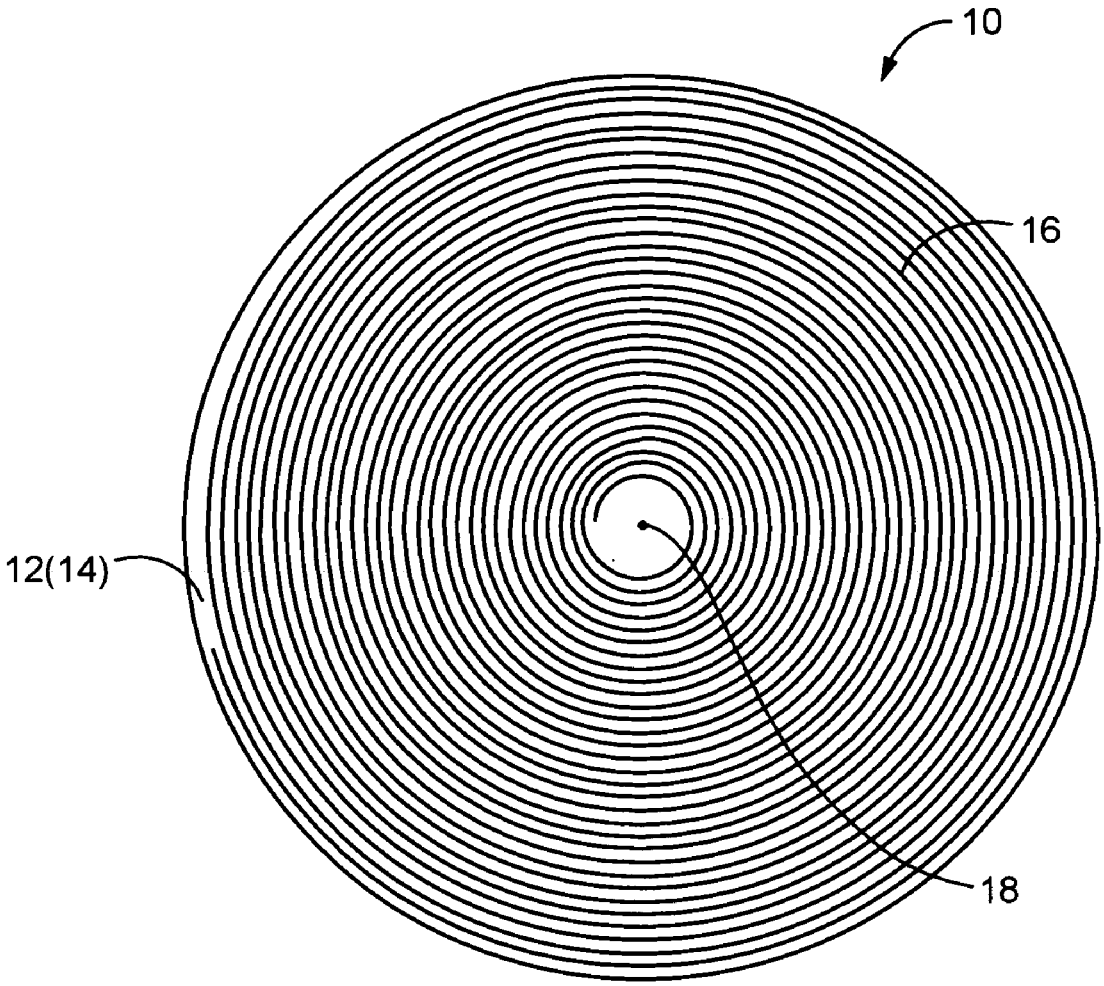
FIG. 2 is a plane view of a polishing pad according to another embodiment of the invention.

The groove 16 may be composed of a plurality of circular grooves 16, 16, 16 . . . each extending about the center axis 18 as its center of curvature, but at mutually different radii of curvature, as shown in FIG. 1, or alternatively of a single or plurality of grooves 16 arranged about the center axis 18 in a spiral configuration with gradually increasing radius of curvature, as shown in FIG. 2. Regardless of whether a plurality of grooves are arranged concentrically as shown in FIG. 1, or one or a number of grooves are arranged in spiral configuration as shown in FIG. 2, a diametric pitch, which is defined as the distance between points of intersection with radial lines of the grooves on a single line drawn across the diameter, may be constant across the entire diameter, or change gradually over portions of, or the entirety of, the surface.

Here, the groove 16, at least partially across the diameter of pad substrate 12, is formed as a slant groove(s) having slant structure according to the invention.

As a specific example, shown in enlarged longitudinal cross section in FIG. 3, the groove 16 has an inner diameter side wall (hereinafter referred to as "inside wall") 20 and an outer diameter side wall (hereinafter referred to as "outside wall") 22, both of which are slant faces slant by a predetermined angle $\alpha$($\alpha$=intersect angle with a straight line parallel to the center axis 18) with respect to the center axis 18 around the entire circumference. That is, in the groove 16 shown in FIG. 3, the inside wall 20 and the outside wall 22 are mutually parallel faces, with the groove 16 having a substantially constant width dimension B over the entirety of groove 16, not only in the circumferential direction but also the depthwise direction thereof. The groove 16 going towards the opening thereof moves gradually further away toward the outer diameter side from the center axis 18 to open diagonally outward in the diametric direction of pad substrate 12.

The floor of the groove 16 is not limited as to shape, and may curved or flat, for example. In the present embodiment, the floor of the groove 16 is a flat surface orthogonal to the center axis 18 of the polishing pad 12. Where the floor of the groove 16 is a flat surface substantially parallel to the surface of the polishing pad 12, a gap can be effectively maintained at the floor of the groove 16 even where the groove 16 has a large effective depth, so that good strength characteristics are achieved.

Specific design values for the various dimensions, slant angle etc. for the groove 16 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the groove 16, e.g., the groove width B, depth D, diametric pitch P, and slant angle $\alpha$ may fall within the following ranges.

[For Circumferential Groove of Generally Circular Shape]

$0.005\ \text{mm} \leqq B \leqq 3.0\ \text{mm}$ $0.1\ \text{mm} \leqq D \leqq 2.0\ \text{mm}$ $0.1\ \text{mm} \leqq P \leqq 10.0\ \text{mm}$ $0.5° \leqq \alpha \leqq 30°$

[For Linior Groove]

$0.005\ \text{mm} \leqq B \leqq 3.0\ \text{mm}$ $0.1\ \text{mm} \leqq D \leqq 2.0\ \text{mm}$ $0.1\ \text{mm} \leqq P \leqq 60.0\ \text{mm}$ $0.5° \leqq \alpha \leqq 30°$ More preferably, the above described several values for the groove 16 may fall within the following ranges.

[For Circumferential Groove of Generally Circular Shape]

$0.05\ \text{mm} \leqq B \leqq 2.0\ \text{mm}$ (more preferably: $0.2\ \text{mm} \leqq B \leqq 1.0\ \text{mm}$)

$0.1\ \text{mm} \leqq D \leqq 1.0\ \text{mm}$ $0.2\ \text{mm} \leqq P \leqq 5.0\ \text{mm}$ $1.0° \leqq \alpha \leqq 15°$

[For Linior Groove]

$0.05\ \text{mm} \leqq B \leqq 2.0\ \text{mm}$ $0.1\ \text{mm} \leqq D \leqq 1.0\ \text{mm}$ $0.2\ \text{mm} \leqq P \leqq 30.0\ \text{mm}$ $1.0° \leqq \alpha \leqq 15°$ It should be appreciated that if the groove width B is too small, it becomes difficult to achieve the slurry flow controlling action afforded by the groove 16, and the groove 16 will tend to become clogged with polishing residues and the like, so that consistent effect is not readily achieved. On the other hand, if groove width B is too large, the edge portions (edges of the opening) of the groove 16 will have increased contact pressure against the wafer, tending to bite into the workpiece during polishing, making it difficult to achieve consistent polishing.

If the groove depth D is too small, it becomes difficult to achieve the slurry flow controlling action afforded by the slant groove 16, and the excessive rigidity of the surface 14 of the polishing pad 10 results in uniform contact pressure against the wafer overall, so that contact pressure against the wafer at the edge portions of the groove 16 will tend not to be high enough to conduct polishing effectively. If the groove depth D is too large, not only is the pad difficult to manufacture, but the surface 14 of the polishing pad 10 will tend to deform easily, and there is a risk of stick slip, whereby polishing tends to be inconsistent.

If the diametric pitch P is too small, the pad becomes difficult to manufacture, and the surface 14 of the polishing pad 10 will tend to deform or become damaged easily, making it difficult to achieve consistent polishing. If on the other hand diametric pitch P is too large, it becomes difficult to achieve the slurry flow controlling action afforded by the groove 16.

If the slant angle $\alpha$ of the inside and outside walls 20, 22 is too small, it likely to become difficult to achieve the slurry flow controlling action produced by centrifugal force, described later. On the other hand, if slant angle $\alpha$ of the inside and outside walls 20, 22 is too large, not only is the pad difficult to manufacture, but strength declines at the side walls of the groove 16, making it difficult to achieve consistent planar pressure distribution, and possibly suffering from difficulty in achieving the polishing pad 10 of adequate durability.

Figure 4:
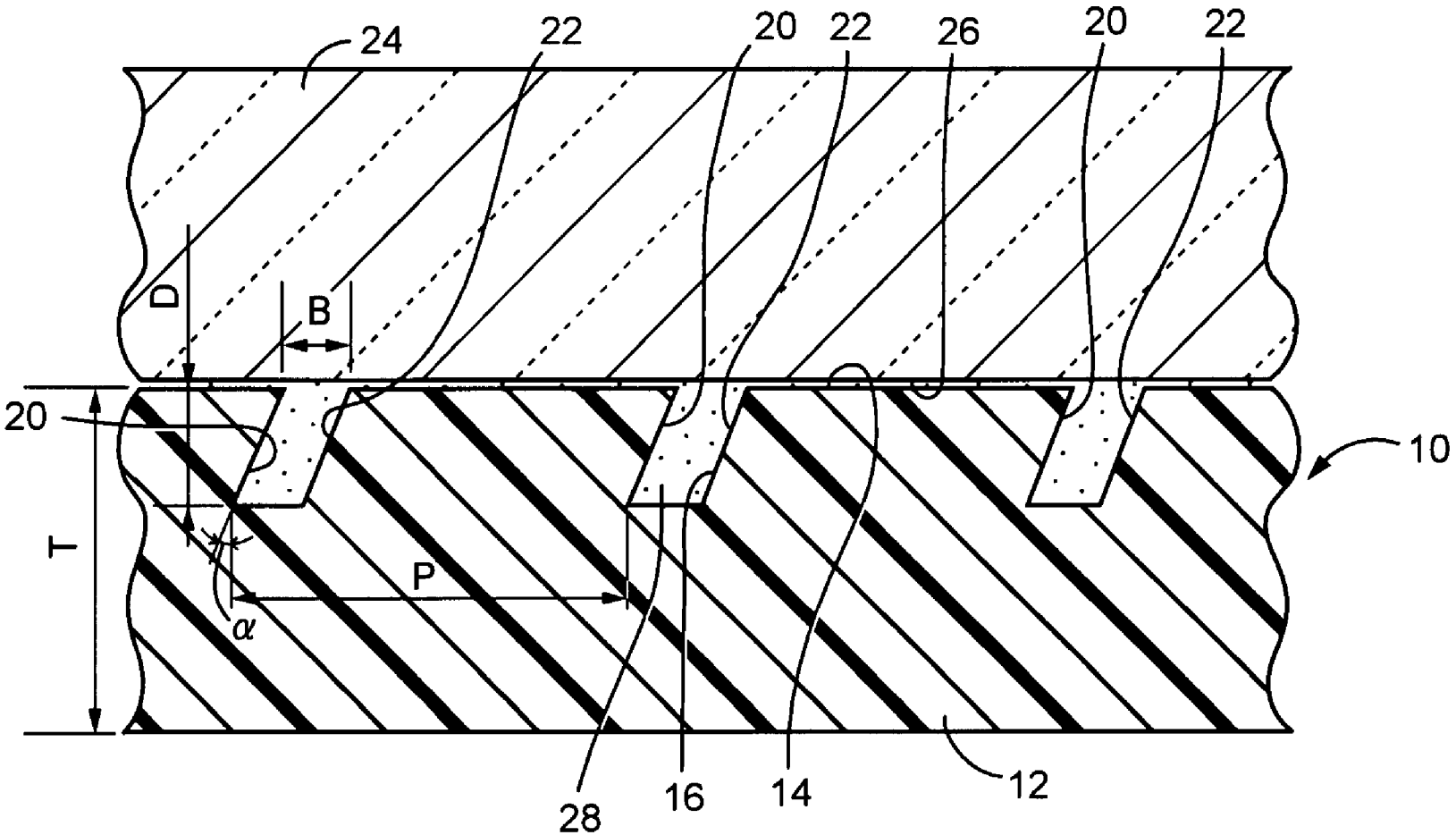
FIG. 4 is a cross sectional view useful for explaining a process of polishing a substrate with the grooved polishing pad of FIG. 3.

The polishing pad 10 having the groove 16 is used for polishing a wafer or the like in the conventional manner. More specifically, as shown in FIG. 4, for example, the polishing pad 10 is arranged on the support face of a rotating plate (support plate) of a polishing apparatus (not shown), and clamped against the rotating plate by air-induced negative pressure suction or other means. Next, while rotating the polishing pad 10 about its center axis 18, a wafer 24 is juxtaposed against the surface 14 for polishing. Generally, during this polishing process, an abrasive liquid (hereinafter referred to as "slurry") 28 is supplied to opposing the faces, i.e. the surface 14 of the polishing pad 10 and the process face 26 of the wafer 24, like the conventional manner, while also rotating the wafer 24 itself about its center axis. The slurry 28 is supplied, for example, to the surface of the polishing pad 10 from the vicinity of the central portion of the polishing pad 10 so as to be spread out over the surface of the polishing pad 10 due to the action of centrifugal force created by rotation of polishing pad 10 about the center axis 12.

In the polishing pad 10, since the groove 16 open in the pad surface 14 gradually slants outwardly in the diametric direction going from the floor to the opening thereof, rotation of the polishing pad 10 about its center axis 18 creates centrifugal force exerted on the slurry 28 present within the groove 16, in turn creating partial pressure in a direction expelling the slurry 28 from the groove 16, so that force corresponding to the rotational speed of polishing pad 10 generates flow that actively expels the slurry 28 from the opening to the outer diameter side while drawing it between the opposing faces of the polishing pad 10 and the wafer 24. In conjunction with this, at the inner diameter side of the groove 16, the slurry 28 in an amount corresponding to that expelled at the outer diameter side of the groove 16 is actively caused to flow into the groove 16.

As a result, effective inflow/outflow of the slurry 28 is created in the groove 16, and active slurry flow is produced between the opposing faces of the polishing pad 10 and the wafer 24, whereby a chemical polishing action of the slurry 28 as well as a mechanical polishing action of the slurry 28 may be realized efficiently and substantially uniformly over the entire interface, thereby providing consistent, effective polishing.

A further advantage of employing the slant groove 16 described hereinabove is that simply by making appropriate adjustments to the slant angle of the groove 16, the flow state of the slurry 28 during polishing can be actively controlled, so that optimal polishing conditions may be produced by adjusting the slant angle of the groove 16 in consideration of the characteristics of the slurry 28 used, the characteristics of the wafer being processed, various polishing parameters, and the like. Described more specifically, as to polishing temperature regulation, the groove 16 may be slant toward the outside of the pad so as to increase an amount of slurry flow, whereby the polishing temperature can be maintained or regulated.

In the slant groove 16, the two walls 20, 22 are mutually parallel in the depthwise direction in addition to the circumferential direction, whereby the width dimension B of the groove 16 is substantially constant across its entire depth. This provides the advantage that even if the polishing pad 10 surface has become worn, or the surface has been ground by means of dressing, the width dimension of the groove open in the surface 14 will nevertheless remain substantially constant, so that consistent polishing action is produced over extended periods.

Figure 5:
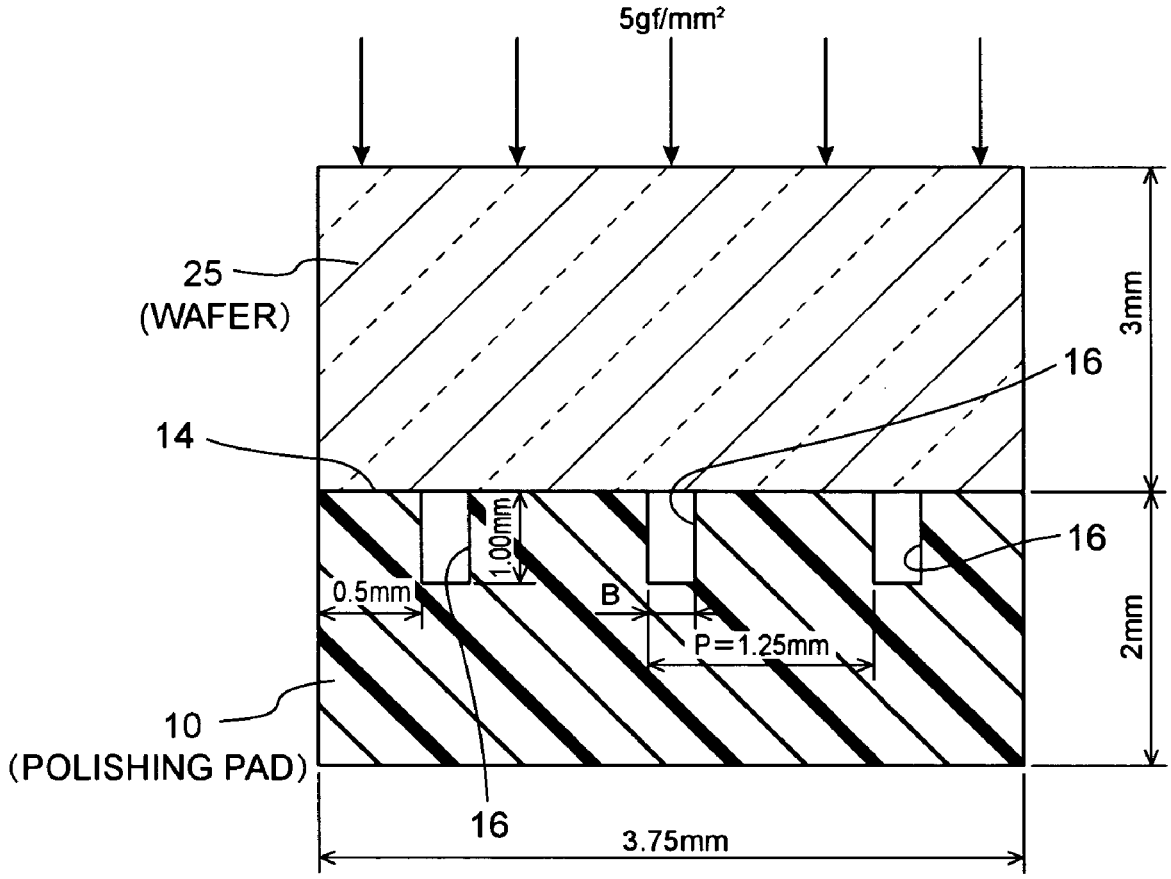
FIG. 5 is a view demonstrating a simulation conducted on a polishing pad for examining effects of variation in a width dimension of a groove of the polishing pad on polishing condition.

A simulation was conducted for examining change in polishing performance by the polishing pad 10 on the wafer 24 in the event of change in the width dimension B of the groove 16. Results of the simulation are demonstrated in TABLE 1, following. The simulation was conducted on a specimen of the polishing pad 10 like that shown in FIG. 5, having the grooves 16 1.0 mm deep formed extending parallel to each other at 1.25 mm intervals, with the groove width dimension B of the groove 16 varied from an initial setting of B=0.25 mm to −20% (B=0.20 mm), −5% (B=0.2375 mm), +5% (B=0.2625 mm) and +20% (B=0.30 mm). For the simulation, cross sectional dimensions of the polishing pad 10 were made rectangular with width of 3.75 mm and thickness of 2 mm, cross sectional dimensions of the wafer 24 were made rectangular with width of 3.75 mm and thickness of 3 mm. The static condition under which the wafer 24 was pressed against the surface of the polishing pad 10 at a static pressing load of 5 gf/mm$^2$ was subjected to stress analysis according to a finite element method. Each groove 16 in the polishing pad 10 was of non-slant configuration extending vertically or in a direction of staking of the polishing pad 10 and the wafer 24. Physical qualities used for the wafer 24 and the polishing pad 10 are given in TABLE 2.

TABLE 1

| GROOVE WIDTH ERROR | MEAN PRESSURE (gf/mm$^2$) (RATE OF DEVIATION FROM NO ERROR [%]) | PEAK PRESSURE (gf/mm$^2$) (RATE OF DEVIATION FROM NO ERROR [%]) |
|---|---|---|
| −20% | 14.26(−4.40) | 5.95(−4.80) |
| −5% | 14.81(−0.74) | 6.17(−1.30) |
| no error | 14.92 | 6.25 |
| 5% | 15.03(+0.74) | 6.33(+1.30) |
| +20% | 15.47(+3.70) | 6.58(+5.28) |

TABLE 2

| PHYSICAL PROPERTIES | POLISHING PAD 10 | WAFER 24 |
|---|---|---|
| Poisson's Ratio | 0.4 | 0.4 |
| Young's Modulus (gf/mm$^2$) | 2143.0 | $1.0 \times 10^7$ |

As is understood from the results in Table 1, even a slight change in the width dimension B of the groove 16 is demonstrated to produce a change on the order of several percent in peak pressure (pressing force) exerted on the wafer 24 during polishing. The magnitude of peak pressure exerted on the wafer 24 directly affects polishing efficiency during wafer polishing, and also significantly affects polishing precision. This reveals that maintaining as constant a value as possible for the groove width dimension B is crucial for the purpose of consistent processing of the wafer 24. Here, the grooves 16 in the polishing pad 10 of the embodiment hereinabove are slant, but since the width dimension B thereof is substantially constant in the depthwise direction, polishing performance is consistent even in the event that the polishing pad 10 surface has become worn, or the surface has been ground down by means of dressing. In contrast, where a groove has a cross section that expands in dimension in the depthwise direction going towards the pad surface, as taught in the above mentioned U.S. Pat. No. 6,238,271, the width dimension changes in the event that the polishing pad 10 surface has become worn, or the surface has been ground by means of dressing. As is readily apparent from the above, it will be extremely difficult to consistently achieve the desired polishing of the wafer.

By slanting the groove 16 with respect to the center axis 18 or polishing pad 10, the component force of centrifugal force generated depending on the particular slant angle $\alpha$ improves the flow of the slurry 28 between the opposing faces of the polishing pad 10 and the wafer 24, leading to improvement in polishing efficiency and polishing precision as has been discussed previously. Apart from the improvement in slurry flow, slanting the groove 16 has also been shown to increase maximum pressure at the contact face of the polishing pad 10 against the wafer 24, and to produce a phenomenon similar to an edge effect, which further improves polishing efficiency. A further simulation was conducted for examining this phenomenon. The result of the simulation will be described in detail.

Figure 6:
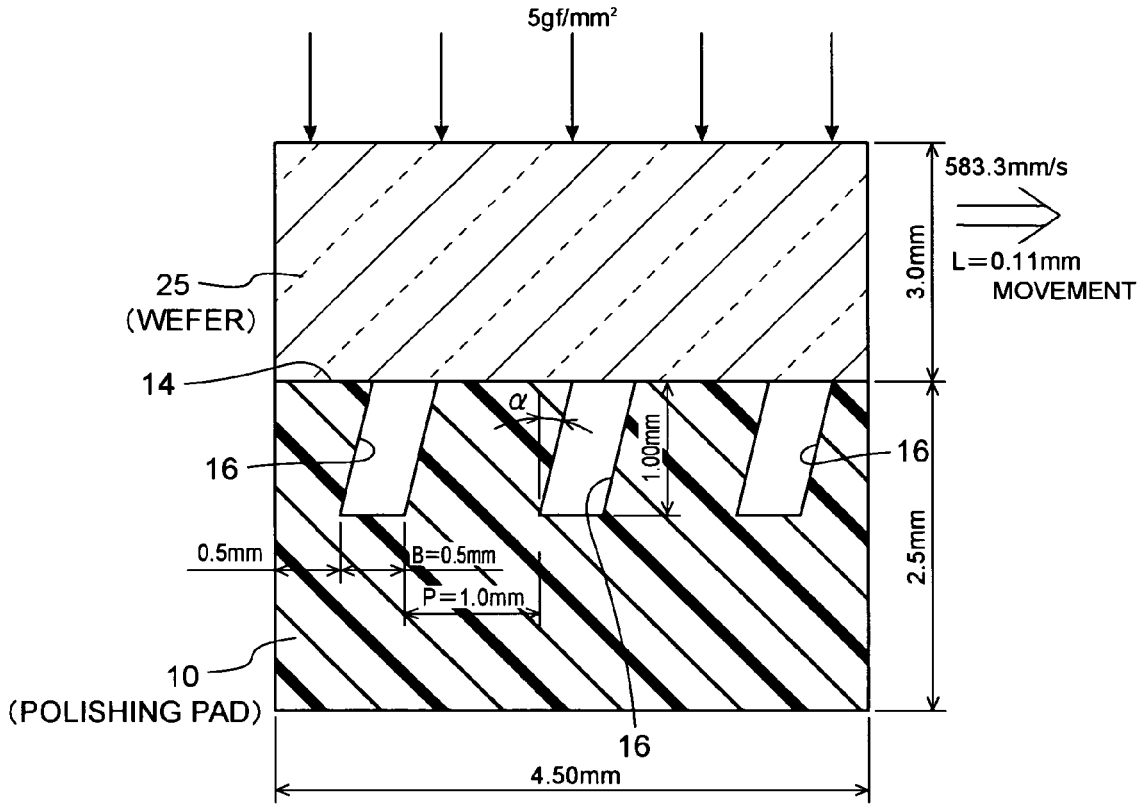
FIG. 6 is a view demonstrating a simulation conducted on a polishing pad for examining effects of variation in a slant angle of a groove of the polishing pad on polishing condition.
Figure 7:
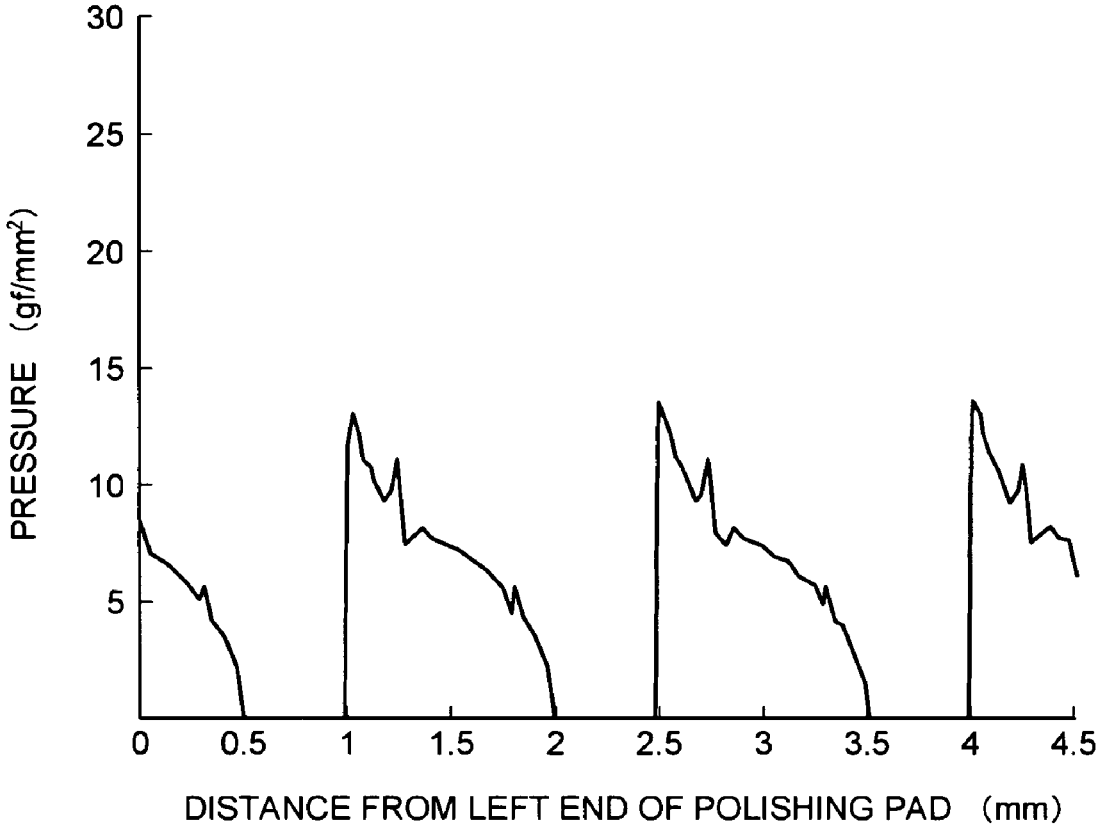
FIG. 7 is a graph demonstrating distribution of a contact pressure of the polishing pad against the wafer as a result of the simulation where the groove has an slant angle $\alpha$: $\alpha=0°$.
Figure 8:
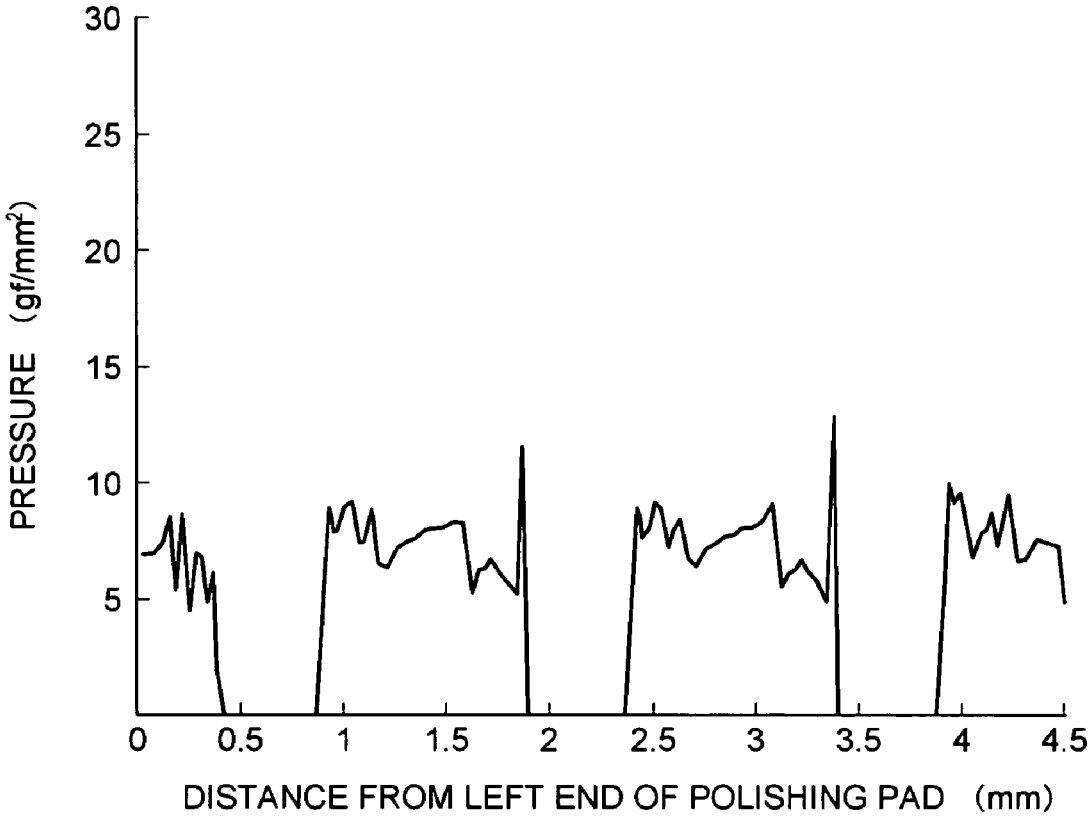
FIG. 8 is a graph demonstrating distribution of a contact pressure of the polishing pad against the wafer as a result of the simulation where the groove has an slant angle $\alpha$: $\alpha=-5°$.
Figure 9:
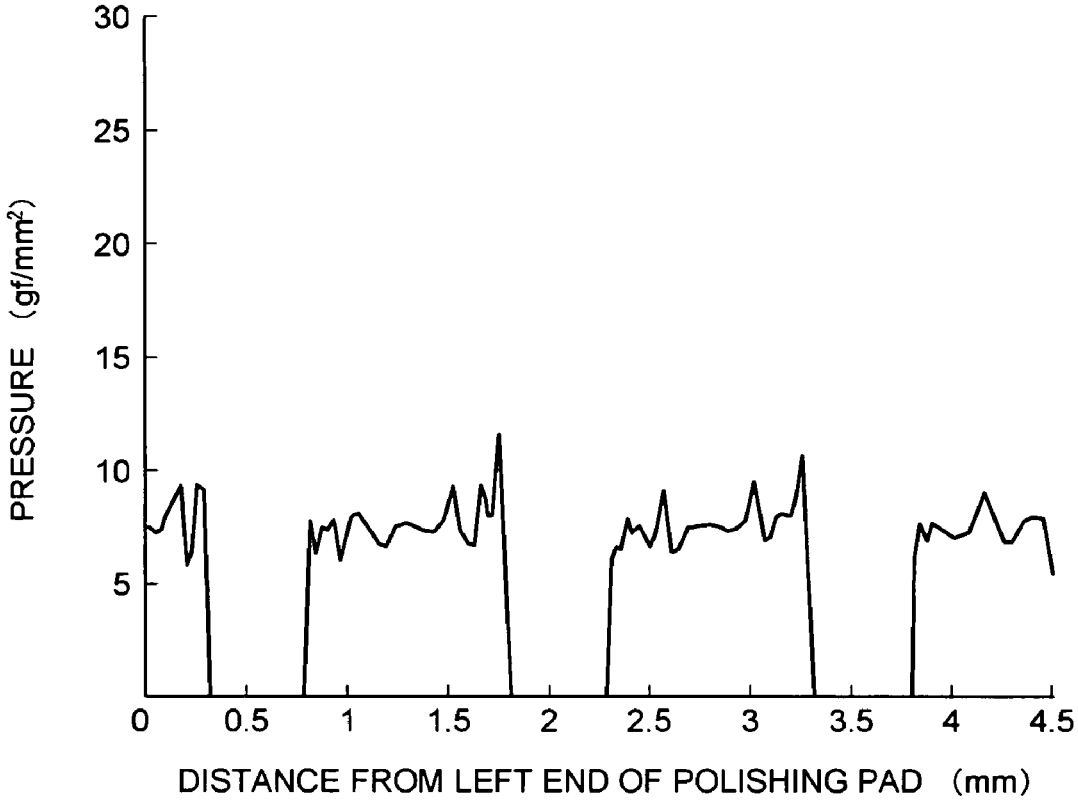
FIG. 9 is a graph demonstrating distribution of a contact pressure of the polishing pad against the wafer as a result of the simulation where the groove has an slant angle $\alpha$: $\alpha=-10°$.
Figure 10:
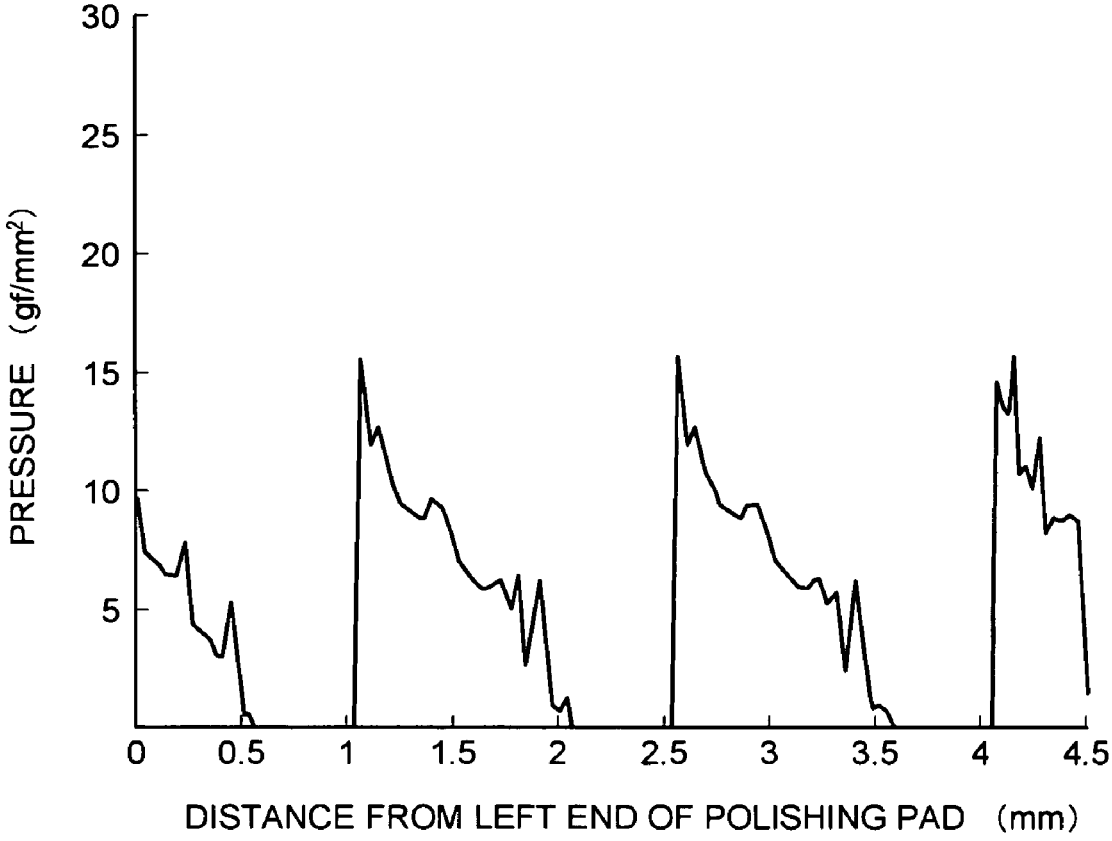
FIG. 10 is a graph demonstrating distribution of a contact pressure of the polishing pad against the wafer as a result of the simulation where the groove has an slant angle $\alpha$: $\alpha=+5°$.
Figure 11:
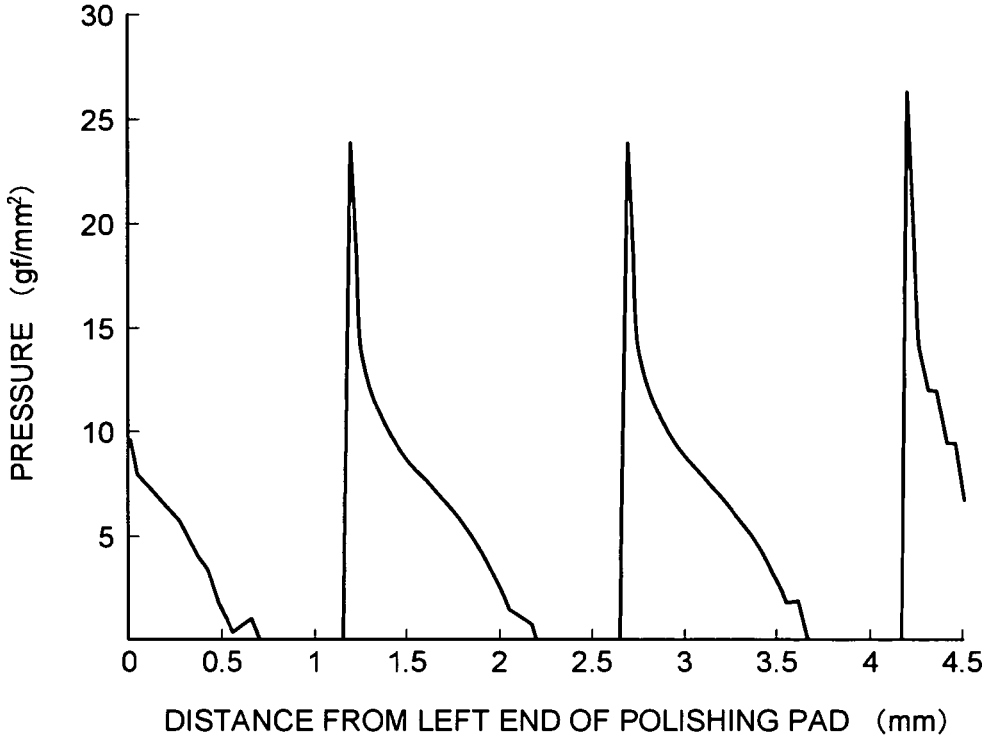
FIG. 11 is a graph demonstrating distribution of a contact pressure of the polishing pad against the wafer as a result of the simulation where the groove has an slant angle $\alpha$: $\alpha=+5°$.

As shown in FIG. 6, this simulation was carried out on a specimen of the polishing pad 10 having grooves 16 1.0 mm deep formed extending parallel to each other at 1.0 mm intervals. With the bottom end face of the polishing pad 10 fixed and a pressing load of 5.0 gf/mm$^2$ applied to a wafer 24 placed on the surface 14 of the polishing pad 10, a polishing process was simulated according to a finite element method, by slightly moving the wafer 24 at a relative speed of 583.3 mm/s towards the horizontal direction (rightward in FIG. 6) with respect to the polishing pad 10. This simulation was conducted with five different values for groove 16 slant angle α: α=0° (opening parallel to pad center axis); α=−5° (opening slant towards pad center axis); α=−10°; α=+5° (opening slant towards pad outer diameter), and α=+10°. Results of the simulation are shown in graphs of FIGS. 7–11, respectively.

For the simulation, cross sectional dimensions of the polishing pad 10 were rectangular with width of 4.5 mm and thickness of 2.5 mm, and cross sectional dimensions of the wafer 24 were rectangular with width of 4.5 mm and thickness of 3.0 mm. Each groove 16 in the polishing pad 10 had constant width dimension B=0.5 mm. Physical properties used for the wafer 24 and polishing pad 10 were in accordance with values of the static simulation parameters (TABLE 2) relating to groove width change, described previously.

As is apparent from the results presented in FIGS. 7–11, by varying the slant angle of the grooves 16, it is possible to significantly and efficiently adjust contact pressure of the polishing pad 10 against the wafer 24 during polishing. Experiments conducted by the inventors has revealed that the greater the maximum value for contact pressure, i.e., the more positive the value of groove 16 slant angle α within a predetermined range and the greater the slant towards pad outer diameter, the greater the improvement in polishing efficiency. This may be attributed to an edge effect or a bite like function of the polishing pad. Thus, by adjusting the slant angle of the grooves 16 of the polishing pad 10 in consideration of the polishing pad and wafer material, required precision, and the like, it is possible to achieve both suitable polishing precision and polishing efficiency. Also, this achieved excellent polishing precision and polishing efficiency can be maintained at consistent level, without being largely diminished by wear of the polishing pad or by dressing.

If the slant angle α of the groove 16 is too large, a phenomenon similar to stick slip may occur, resulting in inconsistent polishing. For this reason, the value of slant angle α is preferably in the range $-30° \leqq \alpha \leqq +30°$, and more preferably $-20° \leqq \alpha \leqq +20°$. In consideration of effectively in slurry flow through centrifugal force, described previously, it is preferably that the value of slant angle α is arranged to meet the following inequality: $0° < \alpha$ so that the grooves open towards the outer diameter. Further, polishing efficiency is effectively increased owing to the above-described edge effect, making it possible to reduce overall processing pressure of the polishing pad required for achieving a desired polishing efficiency, in comparison with the conventional case. Namely, if the processing pressure is too large, the polishing pad will tend to become dull at its outer circumferential part, due to resilient elasticity of the material of the polishing pad. According to the present invention, the desired polishing efficiency can be achieved not by increase of the processing pressure, but through the edge effect of the groove 16. Thus, the groove 16 employed in the invention can eliminate or moderate the problem of dull at the outer circumferential part of the polishing pad.

Referring next to FIGS. 12–18, there will be described grooves 16 formed in polishing pads according to another specific embodiments of the invention. In the interest of brevity and simplification, the same reference numerals as used in the first embodiment will be used in the following embodiments to identify the corresponding components, and redundant description of these components will not be provided.

Figure 3:
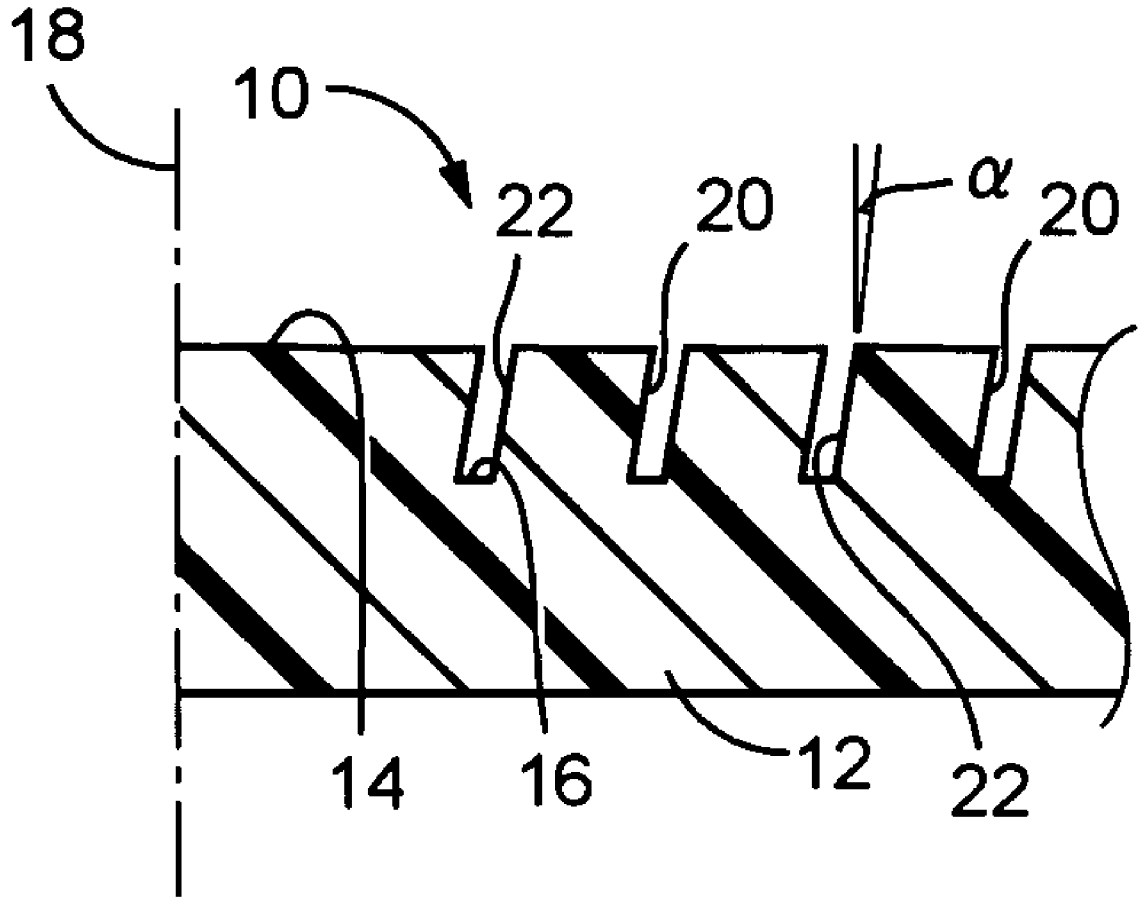
FIG. 3 is a fragmentally enlarged cross sectional view showing one preferred groove construction adapted in the polishing pad of FIG. 1 or 2.
Figure 12:
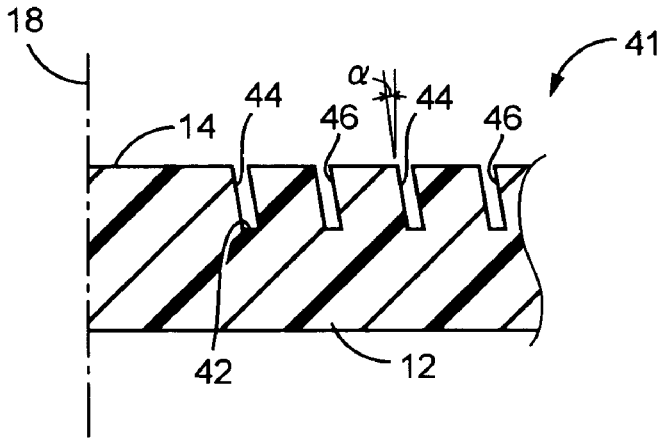
FIG. 12 is a fragmentally enlarged view in cross section of the polishing pad of FIG. 1 or 2 showing another preferred groove construction adaptable in the pad.

Grooves 42 in the polishing pad 41 shown in FIG. 12 have an inside wall 44 and outside wall 46 that both have slant configuration extending in the inside diametric direction towards their openings, as contrasted to the grooves 16 shown in FIG. 3. In this embodiment, the slant angles α of inside wall 44 and the outside wall 46 with respect to center axis 18 are negative and the same, with grooves 42 extending in the circumferential direction between their parallel inside and outside walls 44, 46. In other words, the grooves 42 have substantially constant groove width dimension B over their entire extension.

In the grooves 42 shown in FIG. 12, centrifugal force acting on the slurry 28 entering grooves 42 in association with rotation of the polishing pad 41 exerts force in a direction tending to push the slurry 28 into the grooves 42. As a result, outflow of the slurry 28 from the grooves 42 into the space between the opposing faces of polishing pad 41 and the wafer 24 is controlled to a constraining direction, whereby the flow of the slurry 28 diffusing out from the rotation center of polishing pad 12 towards the outer diameter under centrifugal force can be regulated.

In the grooves 42 shown in FIG. 12, polishing residues and the like entering the grooves 42 can be actively detained on the floor of the grooves 42, thereby effectively preventing any problems that could result from polishing residues or the like entering the space between the opposing faces of the polishing pad 41 and the wafer 24.

In preferred practice, the slant angle α of the grooves 42 will be set to an absolute value within the same numerical range recited for slant angle α of the grooves 16 shown in FIG. 3. The width dimension, depth dimension, and the diametric pitch of the grooves 42 will likewise appropriately lie within the numerical ranges given for the grooves 16 shown in FIG. 3.

Figure 13:
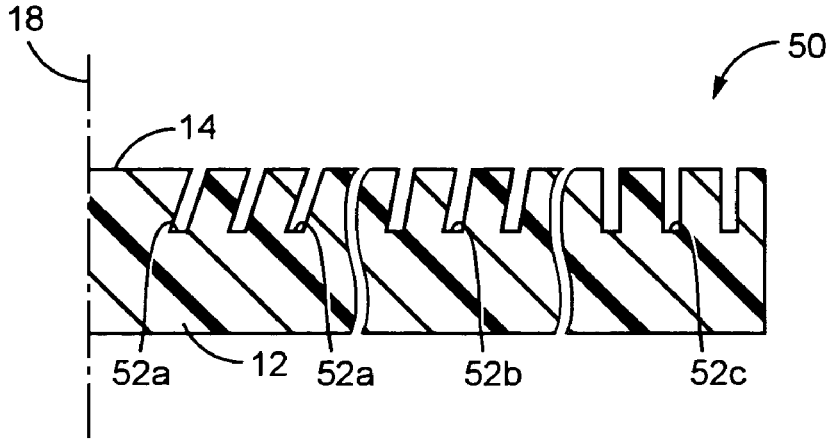
FIG. 13 is a fragmentally enlarged view in cross section of the polishing pad of FIG. 1 or 2 showing yet another preferred groove construction adaptable in the pad.
Figure 14:
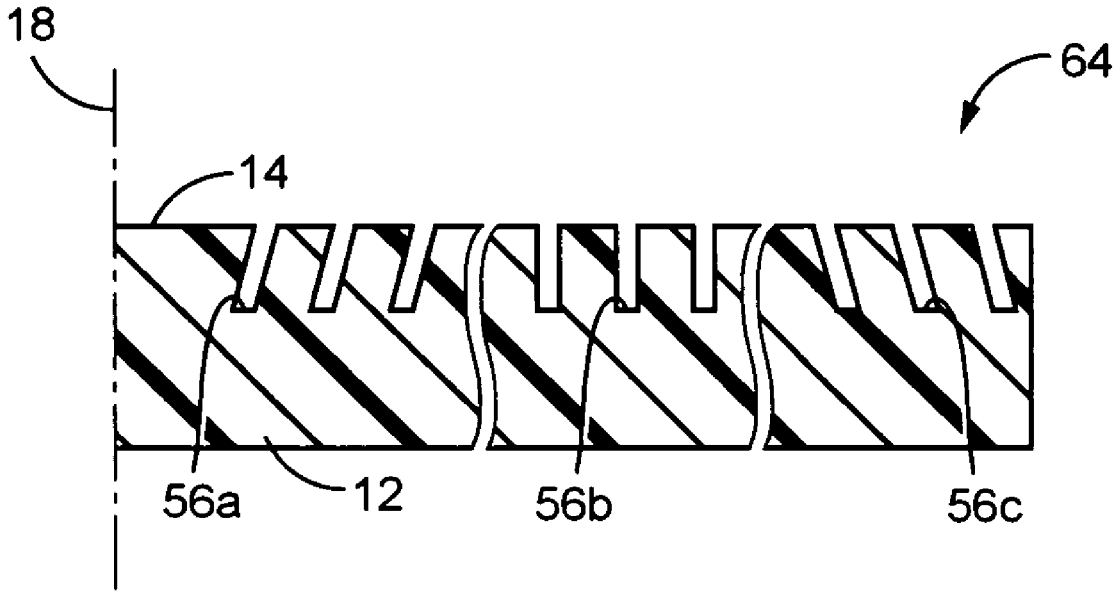
FIG. 14 is a fragmentally enlarged view in cross section of the polishing pad of FIG. 1 or 2 showing still another preferred groove construction adaptable in the pad.

Grooves 52 a polishing pad 50 shown in FIG. 13 and grooves 56 in a polishing pad 54 shown in FIG. 14 are examples of the grooves 52, 56 having different slant angles α values in the diametric direction produced on the surface 14 of a single given polishing pad 50, 54. FIGS. 13 and 14 are diametric cross sections showing only the diametric half of the polishing pad 50 lying to the right of the center axis 18. It is noted that the diametric left half in the drawing will be symmetrical with the right diametric half in relation to the center axis 18.

More specifically described, the inner diameter portion (closer to center axis 18) and in the medial portion in the diametric direction, the grooves 52 of the polishing pad 50 shown in FIG. 13 all slant up (going towards the opening) towards the outer diameter of the pad, as shown in FIG. 3. However, the slant angle α of the grooves 52*b* in the medial portion is the diametric direction (located diametrically outward from the grooves 52*a* in the inner diameter portion) is smaller, and the grooves 52C formed in the outer diameter portion over an even smalle0 α value, namely, approximately 0°, so that the inside and outside walls are all vertical, i.e. rise substantially parallel to the center axis 18. That is, while the grooves 52 width dimension B is substantially constant groove 52 slant angle α becomes progressively smaller going from the center portion towards the outer diameter portion.

With the polishing pad 50 provided with such grooves 52, differences in the level of centrifugal force exerted on the slurry 28 in the grooves 52, the grooves 52—due to difference in peripheral speed at points different distances away from the center axis of rotation 18—can be reduced or eliminated through adjustment of the slant angle of the grooves 52, so that uniform effect on the part of slant grooves 52 can be achieved over the entire surface 14 of the polishing pad 50.

Grooves 56 in the polishing pad 54 shown in FIG. 14 consist in the inner diameter portion (closer to center axis 18) of the pad of the grooves 56*a* that, moving toward the opening, slant up towards the outer diameter side as shown in FIG. 3, whereas the grooves 56*b* located in the diametric medial portion of the pad further to the outside of the grooves 56*a* in the diametric direction have inside and outside walls that are all vertical, i.e. rise substantially parallel to the center axis 18, and the grooves 56*c* formed in the outer diameter portion of the pad farthest away from the center axis 18 have openings that slant towards the inner diameter side as shown in FIG. 12. That is, while the groove width dimension B is substantially constant, groove slant angle $\alpha$ changes from positive to negative going from the center portion towards the outer diameter portion, so as to become progressively smaller.

With the polishing pad 54 provided with such grooves 56, in the inner diameter portion located a small distance from center axis 18 (center of rotation), flow tending to actively expel is imparted to the slurry 28 in the grooves 56, whereas in the outer diameter portion located further away from the center axis 18, flow tending to restrain outflow is imparted to the slurry 28 in the grooves 56. This making it possible to control flow of slurry 28 between the opposing faces of the polishing pad 10 and the wafer 24 in consideration of overall flow.

Figure 15:
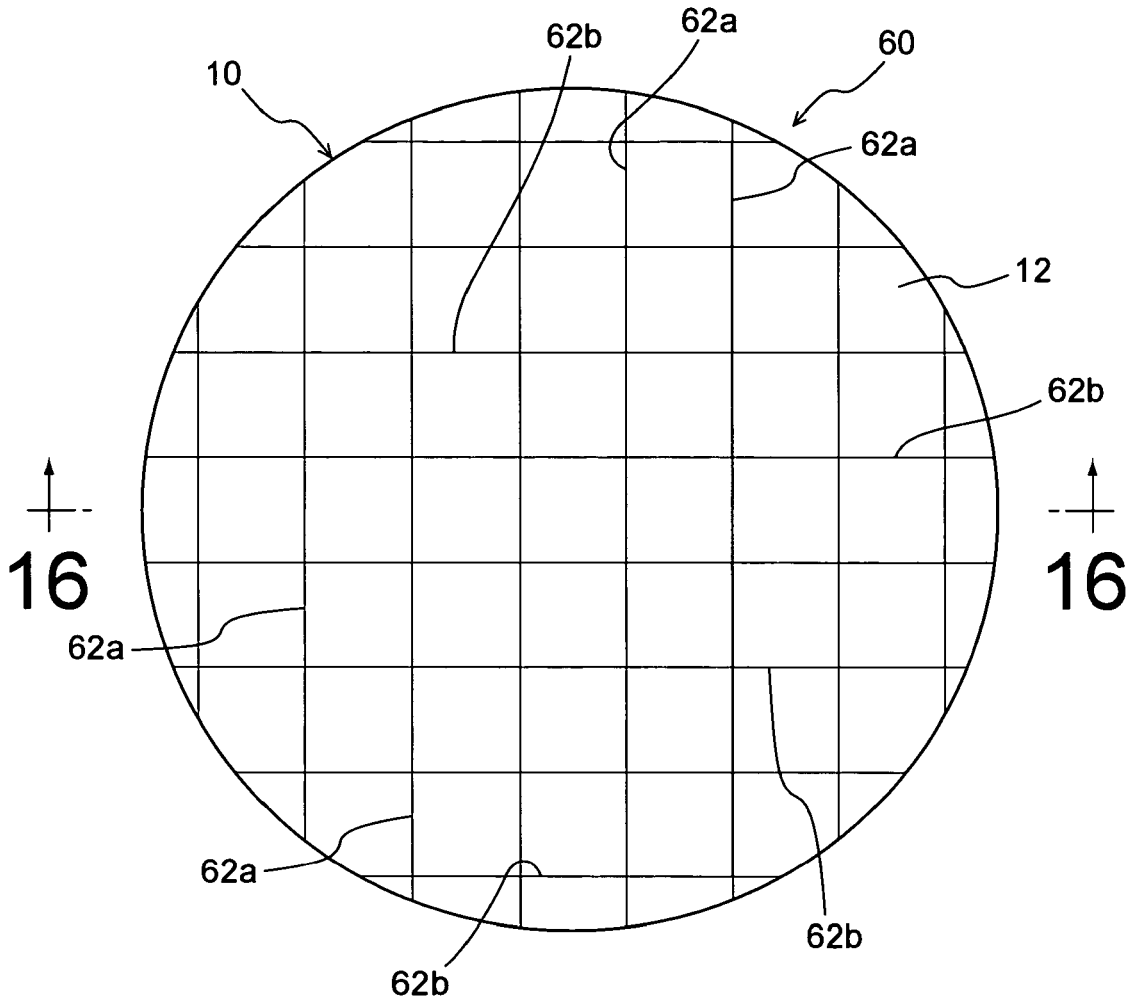
FIG. 15 is a front elevation of a polishing pad according to yet another preferred embodiment of the invention.

Grooves 62 in a polishing pad 60 shown in FIG. 15 consists of a plurality of linear grooves made on the surface 14 of the polishing pad 60. The plurality of grooves 62 are composed of a plurality of first grouping grooves 62*a* extending parallel to one another, and a plurality of second grouping grooves 62*b* extending parallel to one another. The grooves 62*a* of the first grouping and the grooves 62*b* of the second grouping mutually intersect at right angles on the surface 14 of the polishing pad 60.

In this embodiment, the plurality of grooves 62, 62*b* making up each of the groupings are mutually parallel at substantially equal distances apart from each other. As a result, the plurality of grooves 62*a* and 62*b* making up the two groupings intersect one another at substantially right angles, so that the polishing pad 60 surface overall has a multitude of grooves 62 arranged substantially in a grid pattern.

Figure 16:
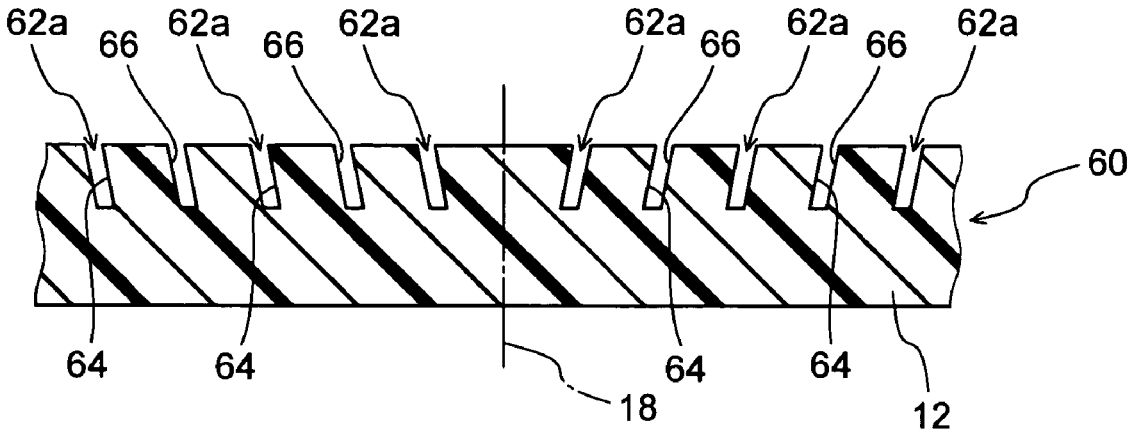
FIG. 16 is a cross sectional view taken along line 16—16 of FIG. 15.

As is apparent from the longitudinal sectional view of the pad shown in FIG. 16, the grooves 62*a* and the grooves 62*b* making up the respective groupings all consist of slant grooves slant in the depthwise direction with respect to the pad surface 14. In particular, the grooves 62*a* and 62*b* have placement and slant angles that are (left/right) symmetrical in relation to the center axis 18 and a single plane of symmetry containing a pad diametric line that is parallel to the grooves 62. In FIG. 16, only the first grouping grooves 62*a* are shown, but if a diametric cross section were taken at a right angle to the cross section shown in FIG. 16, only the grooves 62*b* of the second grouping would be shown in a configuration identical to that in FIG. 16, for example.

The polishing pad 60 furnished with a multitude of such linearly extending grooves 62*a*, 62*b*, can enjoy the same advantages of the present invention as described above, when employed for polishing a wafer by spinning the pad about its center axis 18 as disclosed in the above mentioned U.S. Pat. Nos. 5,921855, 5,984,769 and 6,364,749, for example. Namely, the polishing pad 60 is able to effectively produces a flow-accelerating action on the slurry 28 by means of the slant inside and outside walls 64, 66 of the grooves 62*a*, 62*b*, a polishing efficiency regulating action corresponding to the slant angle of the grooves 62*a*, 62*b*, and other actions similar to that of a polishing pad having circumferential grooves like that shown in FIG. 1.

Figure 17:
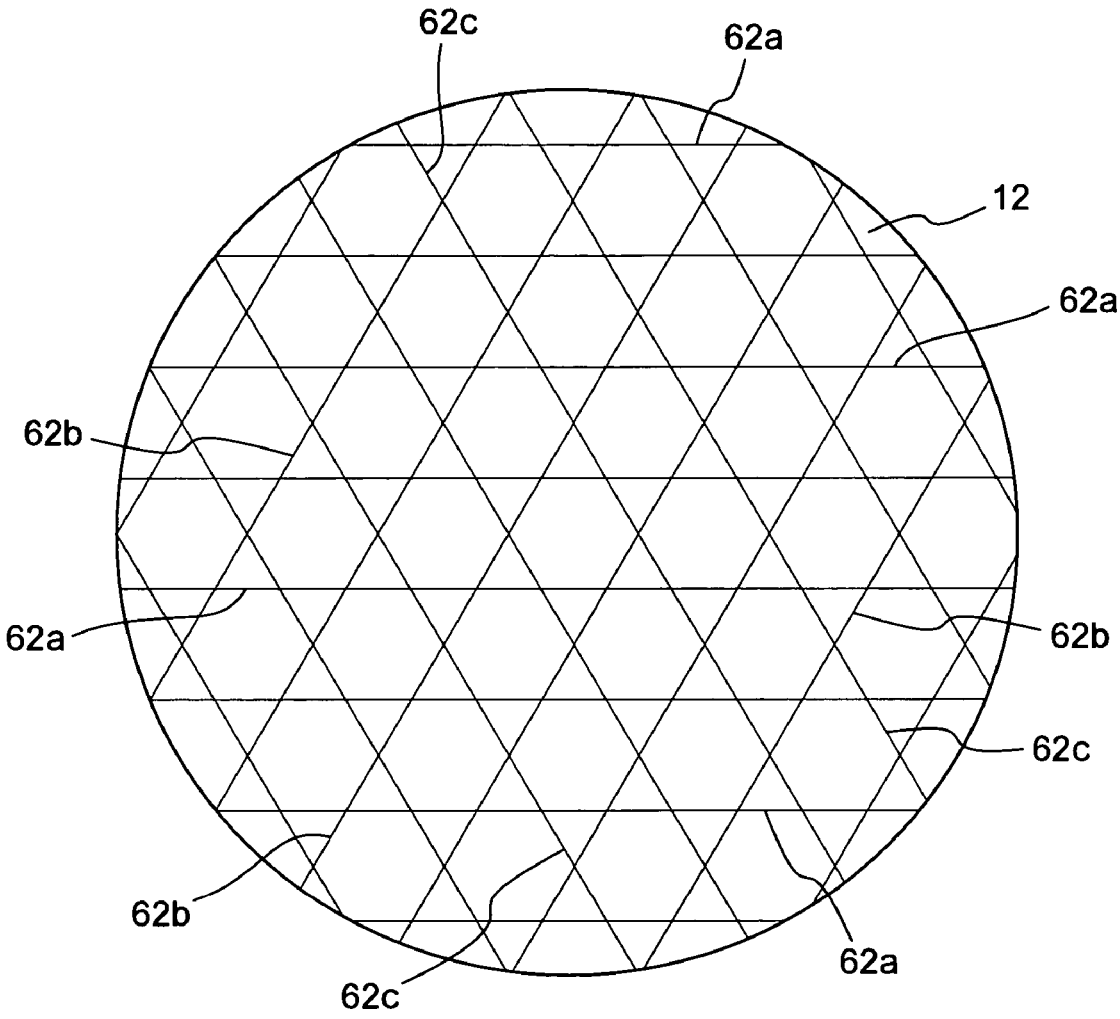
FIG. 17 is a plane view of a polishing pad according to still another preferred embodiment of the invention.
Figure 18:
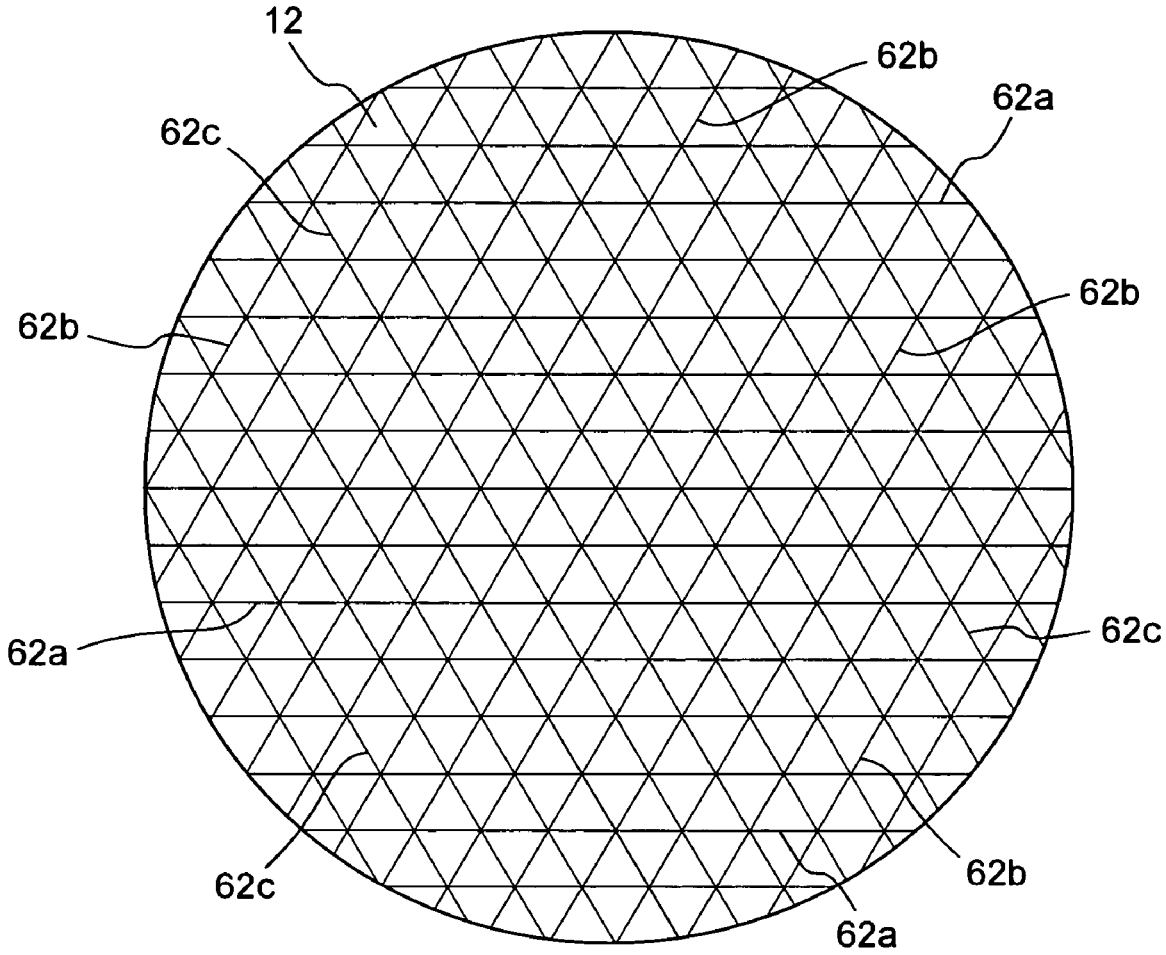
FIG. 18 is a plane view of a polishing pad according to a further preferred embodiment of the invention.

The polishing pad 60 of the present embodiment may be designed with the grooves 62*a*, 62*b* slant such that their openings face diametrically inward, as with the polishing pad shown in FIG. 12, or with the grooves 62*a*, 62*b* having different slant angles depending on location on the surface 14 of the polishing pad 10, as with the polishing pad shown in FIGS. 13 or 14. These arrangements make it possible to control polishing precision and polishing efficiency of wafers, and to regulate slurry flow conditions and the like.

Where a groove pattern composed of a plurality of grooves extending linearly as exemplified above, the pattern, pitch, number of lines etc. produced on the polishing pad 10 substrate 12 can be selected arbitrarily. Specifically, it would be possible as well to employ first, second, and third groove groupings each composed of a plurality of grooves 62*a*, 62*b*, 62*c* extending in mutually different directions, as shown in FIG. 17 and FIG. 18, and the density of the mesh pattern formed by this plurality of groove groupings can be selected arbitrarily as will be apparent from FIGS. 17–18. While not shown in the drawings, a plurality of linear grooves 62 composed of a single or a plurality of groupings may be produced on the surface of polishing pad 10 in combination with grooves 16 extending in the circumferential direction as shown in FIG. 1 or 2.

Figure 19:
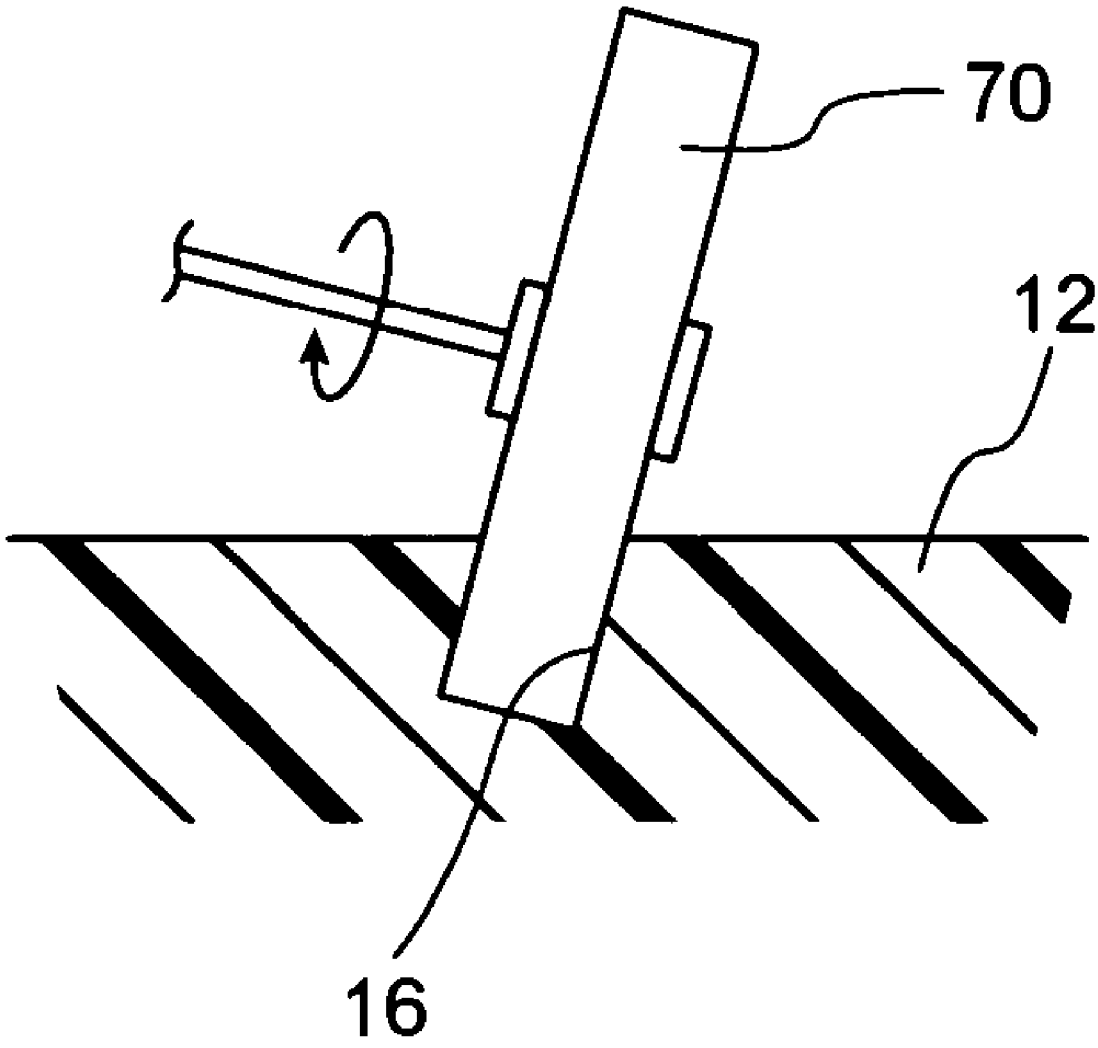
FIG. 19 is a front elevation of one example of a rotary tool adaptable in producing a polishing pad of construction according to the present invention.

These grooves 16, 42, 52, 56, and 62 having the various configurations described hereinabove may be produced on the pad substrate 12 by any of a variety of methods, for example, by forming the grooves simultaneously with the injection molding process for the polishing pad 10, or by a cutting process using a rotary tool 70 (such as a milling cutter) as shown in FIG. 19. Preferably, these grooves may be formed by a cutting process, using a cutting tool equipped with a cutting part of shape corresponding to the groove cross section.

Figure 20:
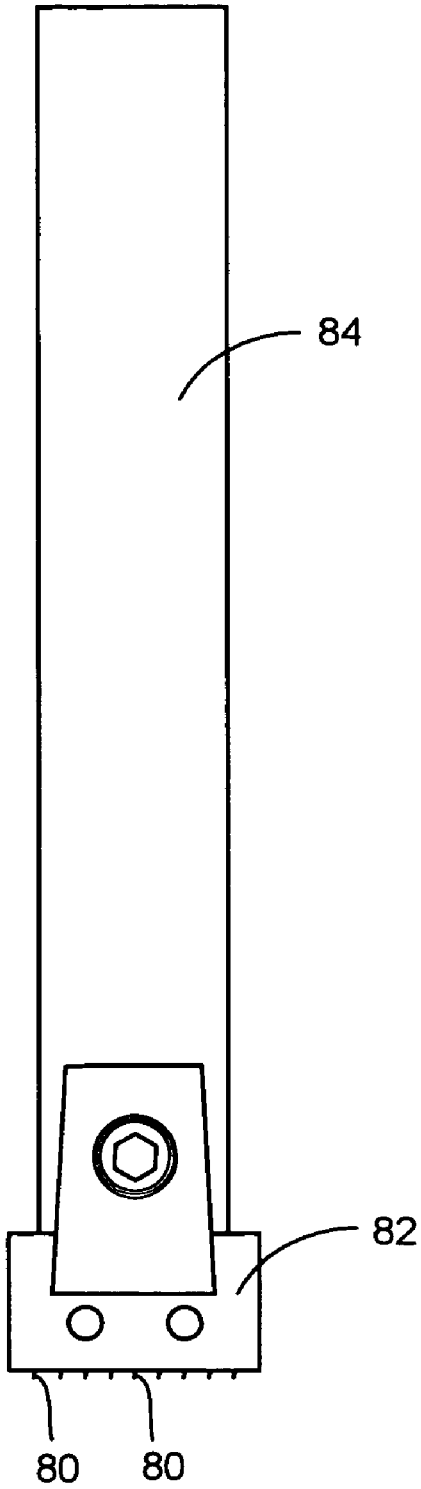
FIG. 20 is a front elevation of one example of a cutting tool adaptable in producing a polishing pad of construction according to the present invention.
Figure 21A:
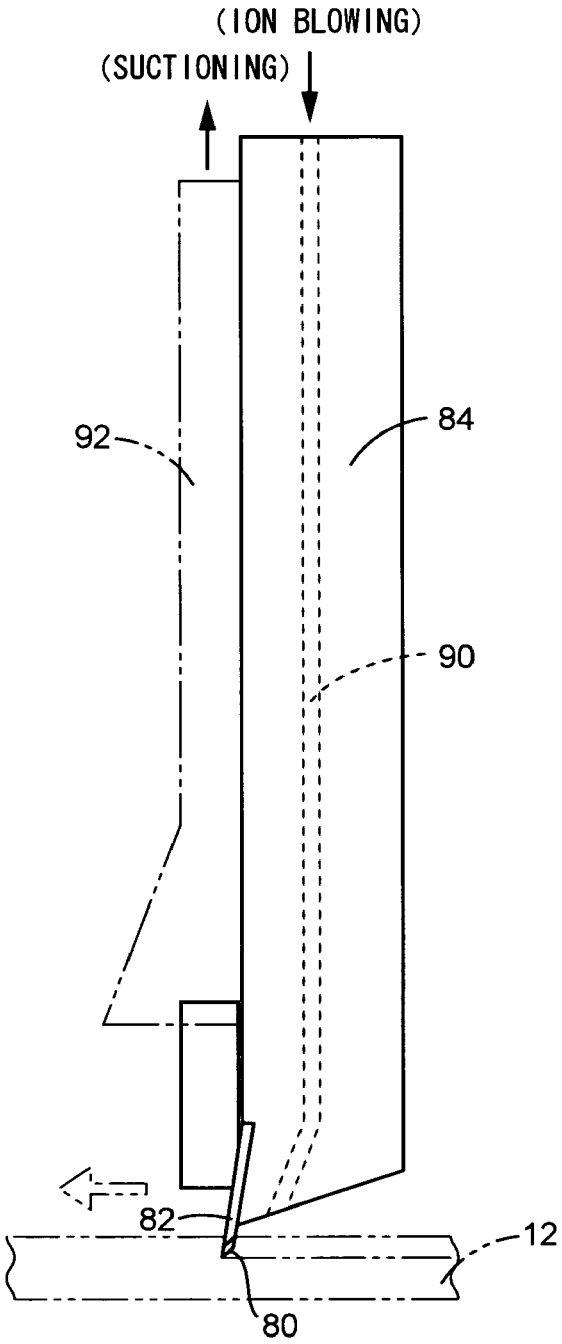
FIG. 21(*a*) is a side elevation of the cutting tool of FIG. 20, and (b) is an enlarged back elevation of a part of FIG. 20 to which a multi-edged tool chip is attached.
Figure 21B:
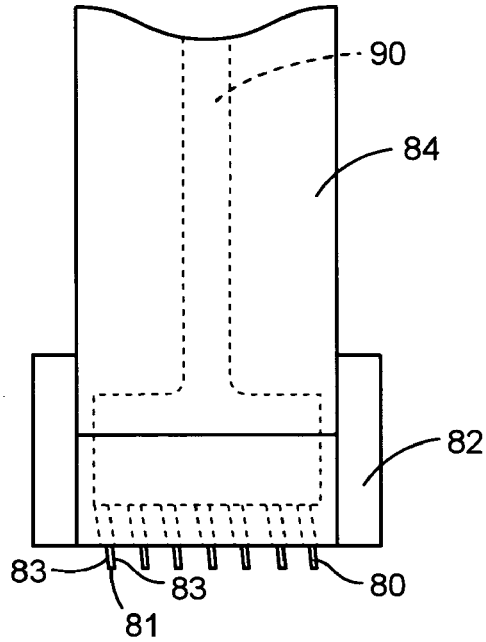

As specifically illustrated in FIGS. 20–21, the desired grooves 16, 42, 52, 56, or 62 can be produced using a cutting tool having a multi-edged tool tip 82 with cutting parts 80 corresponding in shape to the desired grooves arranged at suitable pitch at the distal edge, for example. This multi-edged tool tip 82 is exchangeably fixed to a suitable tool holder 84, to cut the surface 14 of the pad substrate 12.

As shown in FIG. 21(*a*), the tool holder 84 has an ion blowing passage 90 straightly extending through an interior part thereof, while to the front side of the tool holder 84 toward which the cutting parts 80 protrude, a vacuum suction apparatus 92 may be attached. Described in detail, The upper end of the ion blowing passage 90 is connectable to an external air blower for neutralizing static charge, while the lower end of the ion blowing passage 90 is open on the back side of the cutting parts 80 in a direction in which the cutting parts 80 protrude. Ions provided together with compression air from the external air blower (hereinafter referred to as "ion blow") are discharged downwardly with a slant angle substantially equal to that of the cutting parts 80. According to this arrangement, the ion blow is directly discharged to the pad substrate 12 cut by the cutting parts 80 and resultant cut-parts (chips), effectively preventing these members being statically charged, thus advantageously preventing the chips being adhered to the pad substrate, especially to the walls of the grooves, due to the static charge.

Preferably, the direction of discharge of the ion blow is slant toward the front in a cutting direction. Namely, the chips can be transmitted to the front of the multi edged tool tip 82 through the gaps between blades of the multi edged tool tip 82, at the same time when the groove is cut onto the pad substrate. This arrangement permits a further effective prevention of adhere of the chips to the inside of the groove. In this regards, a variety of known air blower for neutralizing static charge may be adoptable as the external air blower connectable to the ion blowing passage 90.

The vacuum suction apparatus 92 can be fixed to the tool holder 84 with its opening portion being open to and located in the vicinity of the front of the cutting parts 80. This makes it possible for the vacuum suction apparatus 92 to promptly suction and collect the chips forwarded to the front of the cutting parts 80 sequentially.

Additionally, as shown in FIG. 21(*b*), the lower end portion of the ion blowing passage 90 is slant with a slant angle substantially equal to that of the cutting parts 80 with respect to the center axis 18 of the pad substrate 12. Accordingly, the ion blow can be effectively applied even to the inner circumferential surface and the floor of the groove 16, which provide undercut formations with respect to the surface of the pad substrate 12, thus making it possible to effectively prevent adhere of the chips to the surface.

Figure 22:
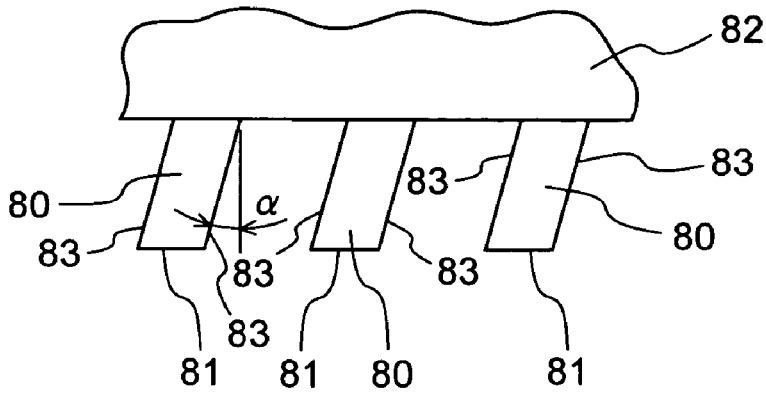
FIG. 22 is a fragmentally enlarged view of one example of a cutting tool suitably adaptable for use in a cutting process for cutting a groove into a polishing pad according to the present invention.
Figure 23:
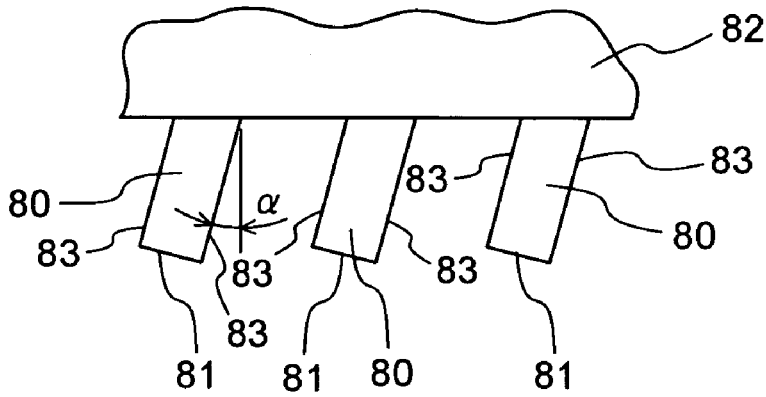
FIG. 23 is a fragmentally enlarged view of another example of a cutting tool suitably adaptable for use in a cutting process for cutting a groove into a polishing pad according to the present invention.
Figure 24:
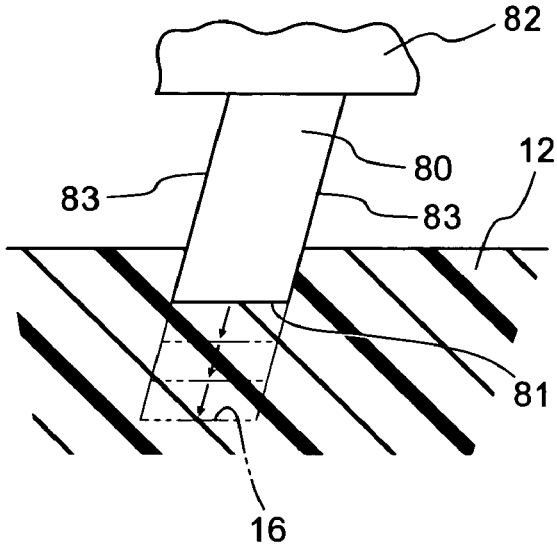
FIG. 24 is a view suitable for explaining a process of cutting a groove into a pad substrate using the cutting tool shown in FIG. 22.

As shown in FIG. 22 or FIG. 23, the cutting parts 80 projecting from the tool are slant by a predetermined angle, corresponding to the slant angle $\alpha$ of the desired grooves 16 etc., with respect to the center axis of the tool holder 84. The cutting tool having cutting parts 80 projected at a given slant makes it possible to effectively cut the grooves 16 having the desired slant angle $\alpha$ in the manner shown in FIG. 24. Namely, the cutting part 80 is placed against the pad substrate 12 while being inclined by a given slant angle $\alpha$. Described in detail, the cutting part 80 includes a cutting edge 81 and two side faces 83, 83 that are slant in a same lateral direction with respect to the cutting edge 81 of the cutting part 80, by the given slant angle $\alpha$. While being projected out further by a predetermined distance in the slant projecting direction, the cutting part 80 is adapted to cut the pad substrate 12, repeating the cutting process for cutting the same groove so as to trace the same cutting location. This operation is repeated several times in an intermittent mode (e.g. reciprocative motion etc.) in the case of a finite shape such as linear grooves or spiral grooves, or in a continuous channel mode in the case of an annular circumferential groove, thus producing the grooves 16 having the desired slant angle $\alpha$, effectively. Particularly when performing continuous cutting in the circumferential direction to form an endless circumferential groove, a projection height of the cutting part 80 may be increased progressively and continuously, rather than after each circuit, during cutting. In this case, the cutting part 80 functions as a grooving tool adapted to cut the groove extending substantially circumferentially onto the surface of the pad substrate 12.

When cutting the groove 16 etc. that extends in the circumferential direction, the desired groove 16 can be produced efficiently by securing the cutting tool to a lathe, and bringing the cutting parts 80 of multi-edged tool tip 82 into proximity with and against the pad substrate 12 while rotating the pad substrate 12 about its center axis 18, to perform cutting in the above manner. Such a turning process is described in co-pending Unexamined Japanese Patent Application 2001-18164 filed by the present Applicant, which is incorporated herein by reference, and will not be described in detail here.

Figure 25:
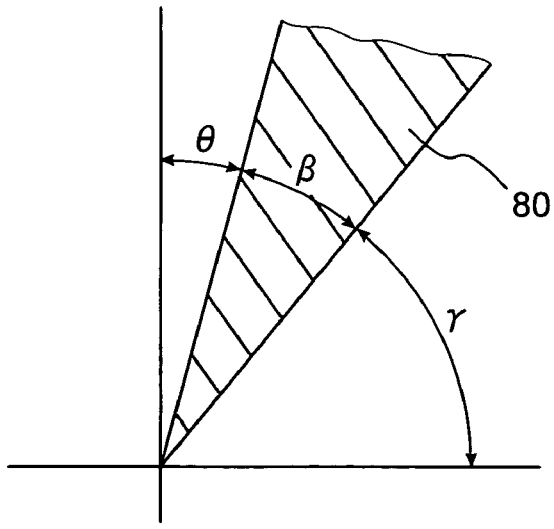
FIG. 25 is a side elevation of the cutting tool shown in FIG. 22.

A specific exemplary preferred configuration for a cutting part 80 for use in a cutting process is shown in FIG. 25, wherein a tooth width is held within the range of 0.005–3.0 mm, corresponding to the width B of the groove to be produced, a blade angle $\beta$ is held within a range of 15–35 degrees, and a front clearance angle $\gamma$ is held within a range of 65–45 degrees. Hence, as the pad substrate 12 is somewhat more elastic than metal or similar materials, if the front clearance angle $\gamma$ is less than 45°, the back portion of the blade 80 will tend to interfere with the pad substrate 12 during cutting. This making it difficult to obtain well-machined groove faces. Particularly when cutting a circumferential groove as shown in FIG. 1, the back portion of the blade 80 tends to interfere with the pad substrate 12 during cutting of the inside diameter portion having a small radius of curvature, and it will therefore be important to set cutting part 80 the front clearance angle $\gamma$ to within the range of 65–45 degrees. Where the front clearance angle $\gamma$ exceeds 65 degrees or the blade angle $\beta$ is outside the range of 15–35 degrees, it becomes difficult to assure an adequate rake angle $\theta$ of the blade front surface, making it difficult to achieve good cutting performance, or to ensure adequate durability and strength.

While the presently preferred embodiments of this invention have been described above in detail for the illustrative purpose only, it is to be understood that the present invention is not limited to the details of the illustrated embodiments, but may be otherwise embodied with various other changes, modifications and improvements, which may occur to those skilled in the art, without departing from the spirit and scope of the invention defined in the following claims.

While a polishing pad of the present invention may be formed with grooves in various configurations, such as grooves extending in the circumferential direction or linearly extending grooves formed in the polishing pad, one or a plurality of portions of a single groove may be slant to produce a slant groove, or some or all of a plurality of grooves may be slant over their entire length to produce slant grooves.

The two substantially parallel side walls of the slant groove used in the present invention need not have the same slant angle in the strict sense, and it is to be understood that the degree of parallelism of the two side walls of slant grooves has a permissible range in consideration of the required degree of polishing precision, the pad substrate material, the wafer material and other factors. If the two side walls of a slant groove slant in mutually opposite directions with respect to the center axis of the pad substrate, there is a risk of significant change in polishing characteristics occurring with wear of the pad or with dressing. It is therefore to be understood that excluding such a case, it is sufficient that the two side walls of the slant groove slant in the same direction in their depthwise direction with respect to the center axis of the pad substrate.

The mode of use of polishing pads of construction according to the present invention is not limited particularly, and the polishing pad of the invention may be used in a variety of different manners, including slurry supply methods, for polishing of various kinds of workpieces, including semiconductor substrates. Nor is the polishing pad of the invention limited to use with CMP processes.

As is apparent from the foregoing description, the polishing pad having a construction of this invention is capable of suitably regulating a polishing condition by controlling a slurry flow during polishing based on a slant angle of a groove, and maintaining the polishing condition approximately constantly. This makes it possible to polish a target-polishing pad of high accuracy with stability.

According to a method of the present invention, a semiconductor substrate, which has been recognized as being difficult to be polished due to soft or narrow metal lines, for example, can be effectively and precisely polished with stability, and accordingly fabricated.

Further, according to a polishing pad producing method of the present invention, a polishing pad having construction of the invention can be stably formed with a groove formed with high preciseness.

By using a grooving tool according to the invention, a groove of the polishing pad can be easily formed by turning with its inner surface being smoothed, making it possible to effectively manufacture a polishing pad of construction of the present invention.

INDUSTRIAL APPLICABILITY

A polishing pad having construction of the present invention is applicable to industrial manufacturing processes of semiconductor substrates, for polishing a semiconductor substrate, especially to a CMP method. A polishing pad producing process of the present invention can be effectively executed in industrial manufacturing processes of polishing pads, and a cutting tool having a construction of the present invention can be advantageously used in industrial grooving process of polishing pads, also. It is accordingly apparent that all of the present invention are industrially applicable.

The invention claimed is:

1. A polishing pad for use in polishing a semiconductor substrate, comprising:

a pad substrate of synthetic resin; and at least one groove formed in a surface of said pad substrate that is used to polish the semiconductor substrate;

wherein:

said groove is at least partially constituted of a slant groove having two side walls that slant substantially parallel to each other in a depthwise direction with respect to a center axis of said pad substrate;

said slant groove is constituted by a circumferential groove extending substantially in a circumferential direction about said center axis of said pad substrate; and said two side walls of said circumferential groove slant outwardly so that an opening of the circumferential groove is located further from the center axis than a base of the circumferential groove opposite from the opening in a diametrical direction of said pad substrate.

2. A polishing pad according to claim 1, wherein said slant groove comprises a plurality of linear grooves each extending linearly.

3. A polishing pad according to claim 1, wherein said slant groove measures 0.005–2.0 mm in a width dimension.

4. A polishing pad according to claim 1, wherein said slant groove is provided with a groove dimensional error of 5% or smaller.

5. A polishing pad for use in polishing a semiconductor substrate, comprising:

a pad substrate of synthetic resin; and at least one groove formed in a surface of said pad substrate;

wherein:

said groove is at least partially constituted of a slant groove having two side walls that slant substantially parallel to each other in a depthwise direction with respect to a center axis of said pad substrate;

the slant groove is constituted by a circumferential groove extending substantially in a circumferential direction about said center axis of said pad substrate; and said circumferential groove is formed in multiple segments spaced apart at intervals on a diametric line of said pad substrate, and a slant angle of said two side walls of said circumferential groove varies depending on a diametric distance away from said center axis of said pad substrate.

6. A polishing pad for use in polishing a semiconductor substrate, comprising:

a pad substrate of synthetic resin; and at least one groove formed in a surface of said pad substrate;

wherein:

said groove is at least partially constituted of a slant groove having two side walls that slant substantially parallel to each other in a depthwise direction with respect to a center axis of said pad substrate;

said slant groove comprises a plurality of linear grooves each extending linearly; and said linear grooves are formed as a plurality of groove groupings each including mutually parallel grooves, said groove groupings being arranged to intersect one another in a substantially reticulated arrangement.

7. A polishing pad according to claim 6, wherein said plurality of linear grooves making up each of said groove groupings have placement and direction of inclination that are substantially symmetrical to one another to either side of a single plane that contains said center axis of said pad substrate and extends parallel to said plurality of linear grooves.

8. A method of fabricating a semiconductor substrate, comprising polishing a semiconductor substrate using a polishing pad, wherein the polishing pad comprises:

a pad substrate of synthetic resin; and at least one groove formed in a surface of said pad substrate that is used to polish the semiconductor substrate;

wherein:

said groove is at least partially constituted of a slant groove having two side walls that slant substantially parallel to each other in a depthwise direction with respect to a center axis of said pad substrate;

said slant groove is constituted by a circumferential groove extending substantially in a circumferential direction about said center axis of said pad substrate; and said two side walls of said circumferential groove slant outwardly so that an opening of the circumferential groove is located further from the center axis than a base of the circumferential groove opposite from the opening in a diametrical direction of said pad substrate.

9. A method of fabricating a semiconductor substrate according to claim 8, wherein polishing said semiconductor substrate comprises polishing under a polishing pressure having a variation held in an order of 2% or smaller.

* * * * *